US010874563B2

(12) United States Patent
Golden, Jr.

(10) Patent No.: US 10,874,563 B2
(45) Date of Patent: Dec. 29, 2020

(54) WHEELCHAIR IMPLEMENT SYSTEM

(71) Applicant: Stephen C. Golden, Jr., Menasha, WI (US)

(72) Inventor: Stephen C. Golden, Jr., Menasha, WI (US)

( * ) Notice: Subject to any disclaimer, the term of this patent is extended or adjusted under 35 U.S.C. 154(b) by 228 days.

(21) Appl. No.: 16/057,489

(22) Filed: Aug. 7, 2018

(65) Prior Publication Data

US 2019/0046374 A1 Feb. 14, 2019

Related U.S. Application Data

(60) Provisional application No. 62/544,909, filed on Aug. 14, 2017.

(51) Int. Cl.
*A61G 5/10* (2006.01)

(52) U.S. Cl.
CPC ..... *A61G 5/10* (2013.01); *A61G 5/1083* (2016.11); *A61G 5/1094* (2016.11)

(58) Field of Classification Search
CPC ..... A61G 5/10; A61G 5/1094
See application file for complete search history.

(56) References Cited

U.S. PATENT DOCUMENTS 4,132,423 A 1/1979 Chant
4,458,870 A 7/1984 Duncan
5,040,813 A 8/1991 Cumbie
5,113,959 A 5/1992 Mastov
5,246,240 A 9/1993 Romich
5,273,304 A 12/1993 Berkheimer
6,254,116 B1 7/2001 Szumlic
6,311,999 B1 11/2001 Kueschall
6,685,264 B2 2/2004 Mullen
7,506,709 B2 3/2009 Kiwak
7,520,518 B2 4/2009 Peterson
7,735,847 B2 * 6/2010 Dougherty ..... A61G 5/003 280/304.1
7,766,342 B2 8/2010 Fast
8,152,192 B2 * 4/2012 Dougherty ..... A61G 5/1089 280/304.1
8,231,090 B2 7/2012 Cramer
8,348,293 B1 * 1/2013 Lasher ..... A61G 5/10 16/30

(Continued)

FOREIGN PATENT DOCUMENTS

DE 202018001412 U1 4/2018
WO WO/2010/139507 A1 9/2010
WO WO/2011/153585 A1 12/2011

*Primary Examiner* — Kevin Hurley
*Assistant Examiner* — Marlon A Arce

(57) ABSTRACT

Disclosed are provisions for enabling a user of a wheelchair to rapidly outfit a first side of the wheelchair with a first implement or a second implement, both implements having adaptive functionalities, and also for enabling the user to perform the same in conjunction with a second side of the wheelchair. Useful implements include those having: A.) ground-contacting functionalities, such as improving navigation over rough terrain and adding forward stability to the wheelchair, and B.) non-ground-contacting elevated functionalities, including holding an umbrella, carrying an electronic device, or supporting a tray, work surface, or other auxiliary load.

20 Claims, 32 Drawing Sheets

(56) References Cited

U.S. PATENT DOCUMENTS

| | | | | |
|---|---|---|---|---|
| 8,414,008 | B2 * | 4/2013 | Hay | A61G 5/06 280/250.1 |
| 8,573,622 | B2 | 11/2013 | Papi | |
| 8,585,071 | B2 | 11/2013 | Golden, Jr. | |
| 8,613,350 | B2 | 12/2013 | Nease, III | |
| 8,651,507 | B2 * | 2/2014 | Kylstra | A61G 5/10 280/250.1 |
| 8,684,113 | B1 | 4/2014 | Laconis | |
| 9,700,469 | B2 | 7/2017 | Golden, Jr. | |
| 9,950,733 | B2 | 4/2018 | Golden, Jr. | |
| 2013/0009372 | A1 * | 1/2013 | Willis | A61G 5/1054 280/86.5 |

* cited by examiner

ROTATE GROUND-CONTACTING IMPLEMENT DOWNWARD TO DEPLOY

ROTATE NON-GROUND-CONTACTING IMPLEMENT UPWARD TO DEPLOY

PRE-DEPLOYMENT STAGE

DEPLOYMENT STAGE

ROTATE NON-GROUND-CONTACTING IMPLEMENT DOWNWARD TO DEPLOY

WHEELCHAIR IMPLEMENT SYSTEM

CROSS-REFERENCE TO RELATED APPLICATION

This application claims priority to, and is a continuation of, U.S. Provisional Patent Appl. Ser. No. 62/544,909, "A Latching Wheelchair Reconfiguration System and Related Methods and Devices," filed Aug. 14, 2017, which is hereby incorporated by reference in its entirety for all purposes.

BACKGROUND OF THE INVENTION

1. Field of the Invention

This invention relates to adaptations achieved with wheelchairs, related systems and devices, and methods for use, such as for personal mobility and for performing activities of daily living.

2. Description of Related Art

For individuals who must rely on the wheelchair as an essential conveyance to perform activities of daily living and for personal mobility, rehabilitation requires consideration of a broad range of factors involving the expertise of at least several clinicians, each having specialized knowledge of wheelchairs and optimal application thereof for the sake of the patient's overall physical and psychological well-being.

Individuals who utilize wheelchairs for their daily mobility typically do so under the direction of physicians and physical therapists that are well-versed in the application of adaptive mobility devices. Other clinicians, including occupational therapists and recreation therapists may also participate in the effort to assist an inpatient or outpatient wheelchair-user to set and achieve rehabilitation goals. Objectives addressed by such a team approach often include: helping the patient regain sufficient physical strength and stamina to be able to navigate indoor and outdoor spaces, helping him or her develop skills and awareness to safely perform transfers from one seating surface to another (such as from a wheelchair into an automobile), and helping the patient resume commonplace activities such as dressing, bathing, toileting, cooking, and taking care of children, as well as indoor and outdoor recreation for exercise, camaraderie, and personal enjoyment. Additionally, clinical practices emphasize the independence and safety of the individual, looking holistically at his or her day-to-day activities in the home, in the neighborhood, and in the surrounding community.

Wheelchairs have evolved substantially over the last several decades, incorporating strong and lightweight structural materials such as aluminum, titanium, and carbon fiber, as well as improved ergonomics and application of CAD engineering tools to create and manufacture highly-customized frame designs. Additionally, parts and accessories for modern wheelchairs, including wheels, wheel locks, device holders and other add-on accessories, have become increasingly popular and universal.

For the individual wheelchair user, a consequence of daily use is an acknowledgement of the wheelchair as an extension of the physical self, essential to the user for freedom and enjoyment, and as a convenient tool for performing ordinary, "everyday" tasks. It is often the case that, in time, a wheelchair user will learn various ways of usefully improving or otherwise reconfiguring the wheelchair, whether under the direction of clinicians, through observing peers, or through personal experimentation. Therefore, it is desirable and commercially viable to avail wheelchair users of opportunities to augment the functionality of their wheelchairs by customizing and accessorizing with a variety of lightweight, minimal, and aesthetically-appealing attachable devices.

Universal wheelchair attachment systems, devices, wheelchairs, and methods have been devised. Embodiments hereafter described, while typically addressing one or more weaknesses in the prior art need not directly or indirectly address all or any weaknesses in the prior art mentioned herein to be within the scope of the various embodiments hereafter claimed. Further, any advantages stated or apparently inherent to any of the embodiments described hereafter are not intended as limitations that must necessarily be found in any or all aspects of the invention.

SUMMARY OF THE INVENTION

The present invention is directed at solving the general problem of limited versatility of modern "everyday" wheelchairs, and aims to solve this problem by exploiting at least one of the front lateral portions of the wheelchair to attach at least one of a plurality of positionable implements in a desired orientation, especially in a manner that enables operation by an occupant of the wheelchair, or by an assistant thereof, while the occupant of the wheelchair is able to remain in a comfortable, substantially upright, seated position. Implements, as manifested in embodiments of the present invention, include those for ground-contacting applications and those for elevated, non-ground-contacting applications and which are particularly adapted for use with a wheelchair that has been equipped or retrofitted for attachment and deployment of said implements.

A further aim of the present invention is to enable the user to return the wheelchair to its original, unadapted configuration or, in other words, to enable repeatable alternation of the wheelchair between: 1.) an original configuration wherein a condition of conventional loading of the wheelchair is undertaken with the wheelchair exhibiting its conventional functionalities, and 2.) a modified configuration wherein the wheelchair is placed in a state of unconventional loading while the implement is maintained in a deployed position.

Conventional loading of the wheelchair may be characterized as having a load carried by the wheelchair, the load being supported by a primary frame, a pair of rear drive wheels and a pair of forward primary caster wheels, having the rear drive wheels and the primary caster wheels securely fastened to the primary frame, and having the pair of forward primary caster wheels contacting a ground surface beneath the wheelchair and supporting a forward portion of the load carried by the wheelchair. In the case of conventional loading, the wheelchair does not share in supporting the load with any auxiliary member or adaptive device extending from the primary frame.

Unconventional loading, on the other hand, may be characterized as having the load carried by the wheelchair, the load being supported by the primary frame and the pair of rear drive wheels, with the wheelchair also sharing in supporting the load with an auxiliary arm, holder, or other implement device which extends from the primary frame and is capable of attachment and removal relative to the primary frame. During unconventional loading, the wheelchair shares in supporting the load with an auxiliary member or implement device extending from the primary frame which, in a first case, enables performance of the implement device in an elevated non-ground-contacting capacity or which, in a second case, enables performance of an implement device in a ground-contacting capacity.

Preferred embodiments of the present invention facilitate interchange among a plurality of attachable implements relative to the primary frame, by way of a universal mounting structure, to enable a user to transform the wheelchair into a plurality of modified configurations which place the wheelchair in a condition of unconventional loading, and to enable the user to revert the wheelchair back to its original, unadapted configuration.

A first category of implements enabled by the present invention includes those wherein a load supported by the wheelchair is shared with a ground-contacting implement for improved traversal over irregular surfaces and for greater forward stability. In embodiments of the present invention, mounting structures and load-transitioning elements serve to couple the ground-contacting implement with the wheelchair and to maintain the ground-contacting implement in a predetermined deployed orientation relative to the wheelchair. During deployment, said mounting structures become operatively interposed between the ground-contacting implement and the wheelchair. These elements are subjected to forces in a first direction of loading during deployment of the ground-contacting implement, in that a forward portion of the weight carried by the wheelchair exerts force in the first direction upon the elements operatively interposed between the ground-contacting implement and the wheelchair.

Devices configured according to earlier, closely-related inventions, enable reconfiguration of a wheelchair for the purpose of facilitating traversal and maneuverability over ground surfaces that are substantially more challenging to navigate than most smooth, regular, indoor surfaces. U.S. Pat. Nos. 9,700,469 B2, 9,808,384 B2, and 9,950,733 B2 disclose concepts related to wheelchair reconfiguration for ground-contacting purposes. This reconfiguration is carried out in such a manner as to provide a safe, predictable, and reliable experience for the user, especially in a way that confers rugged, robust modified all-terrain capabilities to the wheelchair when desired, yet in a manner which also permits the user to return the wheelchair to its original, indoor-suitable configuration when desired, with safety and ease. Further, reconfiguration is carried out in such a manner as to maintain the strength and mechanical integrity of the primary structures of the wheelchair, including its frame, footrest, seat, front caster wheel assemblies, rear drive wheels, axle, and all other components originally associated with the wheelchair.

The major advantages of reconfiguring an everyday wheelchair with ground-contacting implements are: 1.) increased forward stability while maneuvering over rough and irregular terrain (thereby preventing the occupant from falling forward out of the wheelchair upon encountering a bump, crack, or soft spot on the ground), and 2.) decreased rolling resistance over outdoor surfaces, as compared to the rolling resistance experienced while the primary caster wheels of the wheelchair are supporting a forward portion of the load carried by the wheelchair. As a result, the user benefits from a decrease in the amount of strain on the shoulders, elbows, wrists and hands, as well as the ability to better attend to the surrounding environment rather than constantly gauge the suitability of the terrain immediately ahead in anticipation of potential obstacles.

The desirability of utilizing the front lateral regions of the wheelchair for the purpose of removably connecting at least one of a variety of ground-contacting implements, notably a pivotable caster wheel assembly comprising a wheel having a diameter of at least 6 inches, has been emphasized in earlier inventions for the purpose of improving the capacity of the wheelchair for navigating over rough or irregular terrain. Similarly, embodiments of the present invention include provisions which effectively exploit the "front lateral regions" common to most types of manually-propelled wheelchairs intended for use by an occupant who fully relies on his or her wheelchair for daily mobility inside and outside the home environment.

In reconfiguring the wheelchair in a manner which imparts increased forward stability and which alleviates the need for strenuous exertion to traverse ordinary terrain, the user becomes more capable of adapting to the demands of outdoor recreation, travel, playing with children in outdoor environments, and attending outdoor gatherings, entertainment venues, and civic events. During travel, encountering long carpeted hallways at hotels and airports become less daunting and pedestrian transit in major cities becomes safer and less intimidating for the user as a result of the added stability of the wheelchair. For the same reason, while moving in a forward direction at average human walking speed, falls are less likely to occur upon encountering irregular pavement on crosswalks and sidewalks.

Having the apparatus within arm's reach from a comfortable seated position in the wheelchair enables the user to return the wheelchair to its original configuration (with the dual, opposing primary front caster wheels in load-bearing contact with the ground surface) without straining while actuating the mechanism and removing any attached implements.

To accommodate a wide variety of wheelchair makes and models, many of which are custom-built for an individual user, the approach presented herein interposes a mount and a rotary latch mechanism assembly between the wheelchair frame and one of the plurality of attachable implements, in such a manner that enables a variety of useful implementations for a broad assortment of wheelchair types and sizes using the same mount. This aim is readily achievable in the case of most "everyday"-type wheelchairs, as they commonly comprise vertical or horizontal frame tube members of standard tube diameters and which are sufficiently strong and rigid to maintain the mechanical integrity of the wheelchair during and after reconfiguration thereof with adaptive implements for the purposes described above.

The present invention expands such useful exploitation of the front lateral regions of the wheelchair to include a second category of adaptive implements which confer capabilities for holding and positioning auxiliary devices not intended for ground contact and which do not change the effective wheelbase of the wheelchair, said auxiliary devices adapted to remain elevated, at all times, from contact with the ground surface below the wheelchair. In the case of non-ground-contacting "elevated type" implements, the wheelchair supports its original load in addition to a load placed thereupon by the elevated type implement and any weight that it may be supporting, for the purpose of enabling the user to carry objects or useful devices while he or she manually attends to the rear drive wheels to propel, steer and stop the wheelchair.

In embodiments of the present invention, mounting structures serve as a coupling and become operatively interposed between the elevated type implement and the wheelchair and are subjected to forces in a second direction of loading during deployment of the elevated type implement, said second direction of loading opposing the first direction of loading undertaken during deployment of ground-contacting implements. In other words, embodiments of the present invention enable and withstand bidirectional load-bearing.

For example, while a clockwise torque is transmitted about a rotation axis of a rotary latch mechanism assembly in the case of attachment of a ground-contacting implement such as a terrain-adapting caster wheel assembly, a counter-clockwise torque is transmitted about the rotation axis of the rotary latch mechanism assembly in the case of attachment of an elevated type implement such as a tray, electronic device holder, or forward luggage carrier.

Thus, both ground-contacting and elevated configurations according to the present invention exploit the front lateral regions of the wheelchair and exhibit unconventional loading factors which are readily distinguished from the factors of conventional loading present while the wheelchair is in its original, unadapted configuration. As a result, the user enjoys compatibility with and interchange among ground-contacting implements and elevated type implements to confer an array of useful adaptations to the wheelchair, particularly while remaining seated in the wheelchair at all times.

Useful implementations may include but are not limited to:

a. Reversibly adapting the wheelchair by removably connecting at least one forward wheel assembly to a forward portion of the frame of the wheelchair for decreased rolling resistance, improved maneuverability, and increased forward stability over rough, irregular or unfamiliar terrain for which the wheelchair is poorly suited in its original configuration;

b. Reversibly adapting the wheelchair by removably connecting at least one motorized forward wheel assembly to a forward portion of the frame of the wheelchair for providing assistive propulsion while the user navigates the wheelchair;

c. Reversibly adapting the wheelchair by removably connecting at least one omnidirectional type wheel to a forward portion of the frame of the wheelchair, the omnidirectional type wheel comprising a series of rollers capable of rotation in a direction tangential to the direction of rotation of the wheel itself, for conferring decreased rolling resistance in the forward and rearward directions without substantially increasing the turning radius of the wheelchair;

d. Reversibly adapting the wheelchair by removably connecting at least one ski or skid assembly to a forward portion of the frame of the wheelchair for improved performance over soft, loose or otherwise unsupportive ground surfaces (into which a wheel tends to sink and becomes a hindrance to forward propulsion), such as over snow, sand, or very loose gravel;

e. Reversibly adapting the wheelchair by removably connecting at least one tray, writing surface, or support surface to a forward portion of the frame of the wheelchair for facilitating activities, especially activities of daily living (ADLs), whether in a home, work, school, or hospital environment, which are otherwise performed with difficulty by the user at times when he or she must also attend to the rear drive wheels of the wheelchair during positioning, propulsion or maneuvering of the wheelchair;

f. Reversibly adapting the wheelchair by removably connecting at least one holding device to a forward portion of the frame of the wheelchair, such as for holding or stowing an umbrella, a fishing pole, a hunting armrest apparatus, a musical instrument holder, a flashlight, a portable electronic device, or other such devices for personal, therapeutic, occupational, competitive sporting or recreational purposes.

Some useful implements may be ground-contacting and load-bearing, such as auxiliary caster wheels or skis, wherein a forward portion of the full load carried by the wheelchair is supported by the implement and wherein the full load carried by the wheelchair is distributed among the implement and the rear drive wheels of the wheelchair. A highly stable configuration involves connecting dual ground-contacting implements, one to each of the opposing left and right sides of the wheelchair frame in order to increase the forward stability of the wheelchair as a whole and also to decrease the resistance to motion experienced at the front of the wheelchair upon encountering rough, irregular, or soft surfaces such as sand, gravel, woodchips or snow.

Other adaptations, many which are found in the prior art pertaining to modern wheelchairs and all-terrain adaptive mobility vehicles, may be usefully integrated with or used in conjunction with the present invention for purposes related to the user's comfort and ease while propelling the wheelchair, especially over surfaces which are not particularly smooth, flat, or level. Embodiments may include vibration-absorbing means such as caster forks configured with elastomeric-, spring-, gas-, or magnetic-type shocks. In some embodiments, it may be preferable to further include caster swivel detention means wherein the swivel joint of the pivotable caster assembly is equipped with a magnet, a spherical retention bearing, a groove, or a spring for the purpose of maintaining the caster wheel in a substantially forward-directed orientation to facilitate travel along a slanted pathway or road surface.

Other useful implements may be intended to be used in conjunction with the modular reconfiguration apparatus but for purposes which do not involve contact with a ground surface. Examples include: supporting an umbrella, a fishing pole, a flashlight, an article of luggage, a baby carriage, a diaper changing surface, or an ironing board, or positioning a portable electronic device (a laptop computer, tablet, phone, or camera), a tray or flat surface for carrying food and beverage, a work surface for carrying papers, books, or supplies while performing schoolwork or performing job-related activities and activities of daily living such as personal care, grooming, and using cosmetic devices and substances, or for serving as a support while aiming a rifle or a crossbow. Elevated type implements thus provide augmented functionalities to the wheelchair and, in many cases, help compensate for functionality that would otherwise be restricted due to the often clumsy nature of wheelchair mobility in which the user must navigate from a seated position in a vehicle (the conventional wheelchair) not ideally suited for movement in and around tight spaces, all the while depending on his or her hands and arms to simultaneously maneuver the wheelchair while performing tasks involving at least a minimal degree of manual dexterity or arm movements to hold, control, manipulate or otherwise attend to an object or person within reach.

Preferred embodiments are lightweight, compact, durable, and aesthetically appealing, which are exemplified by designs, components, construction methods and materials utilized in the bicycle industry and which have gained widespread use in adaptive wheelchair sports and recreation equipment. Modular design principles, such as standardization and partitioning, may be utilized to reduce manufacturing costs, increase the number of configuration options, and allow for proper, customized fitting to a wider range of makes and models of existing wheelchairs available in the marketplace In embodiments, interchangeable connection of a plurality of ground-contacting and elevated type implements to the wheelchair may be achieved by way of a coupling, a quick-release clamp, a quick-release ball-detent mechanism, an expanding insertion pin, a threaded fastener, or other similar releasable connection means, in order to utilize the frame mounting means to universally attach more than one type of implement. For example, a wheelchair configured with left- and right-side semi-permanently fastened frame mounts may be capable of accepting a pair of caster wheel implements, a pair of ski implements, a singular ADL ("activities of daily living") tray, or a singular utility holder for holding devices such as an umbrella, a rifle support, a fishing pole, a medical or IV drip pole, or a flag.

Embodiments may utilize releasable connection means to universally connect more than one type of implement to the rotary latch mechanism assembly, which then attaches to the wheelchair via the frame mounting means. For example, each of a pair of rotary latch assemblies may be releasably coupled with any one of the aforementioned implements, such as with a quick-release clamp or ball detent pin, each of the pair of rotary latch assemblies also being capable of releasably connecting with or attaching to a forward frame portion of the wheelchair; thus, a pair of rotary latch assemblies and a pair of frame mounts serve many useful purposes to dramatically expand the versatility of the wheelchair.

Preferably, components integrated with the device for the purpose of user manipulation such as, for example, a quick-release handle, a control switch knob, or a positive-locking ball detent pin, are located within comfortable arm's reach of the occupant while in the substantially upright seated position. Also, manipulable components are preferably configured to enable a user having limited hand function to successfully attach, tighten, loosen, detach, and adjust attachable adaptive implements as well as to manipulate any control levers or switches incorporated with the device.

In embodiments, a singular rotary latch mechanism assembly is adapted to be unilaterally connected to a left side of a wheelchair or to a right side of the wheelchair. In other embodiments, two rotary latch assemblies are adapted to be independently connected to the left and right sides of a wheelchair and capable of being operated simultaneously in order to alternate the wheelchair between an original, non-load-bearing configuration and a modified load-bearing configuration.

Embodiments of the present invention may, alternatively, be characterized as a universal implement mounting system for a wheelchair, the universal implement mounting system comprising a fixed coupling member adapted to be affixed to or otherwise integrated with a forward lateral portion of the wheelchair, the universal implement mounting system further comprising or adapted to cooperate with a first implement, such as an elevated type implement, comprising a first releasable coupling member, the universal implement mounting system further comprising or adapted to cooperate with a second implement, such as a ground-contacting type implement, comprising a second releasable coupling member, the universal implement mounting system adapted for:

I. Coupling, in a first instance, of a first releasable coupling member disposed on a first implement, with a first fixed coupling member disposed on a first fixed mount, and coupling, in a second instance, of a second releasable coupling member disposed on a second implement, with the first fixed coupling member disposed on the first fixed mount, the second implement comprising a rotary joint having a substantially horizontal rotation axis;

II. Operation of an elevated type implement, connected to one of the first releasable coupling member or the second releasable coupling member, during interposition of the first implement between the wheelchair and an auxiliary load, the elevated type implement being capable of supporting the auxiliary load while maintaining the auxiliary load in a predetermined position;

III. Operation of a ground-contacting implement, connected to one of the first releasable coupling member or the second releasable coupling member, during interposition of the second implement between the wheelchair and a ground surface beneath the wheelchair, the ground-contacting implement being capable of rotation about the substantially horizontal rotation axis to a predetermined deployed position.

In preferred embodiments, the universal implement mounting system is adapted for coupling of the first releasable coupling member to the first fixed coupling member in a direction along a first substantially horizontal lateral line of insertion passing through the first fixed coupling member.

In embodiments, the universal implement mounting system is further capable of coupling a symmetrically-opposing releasable coupling member (that is, which symmetrically opposes the first releasable coupling member), disposed on a symmetrically-opposing implement, to a symmetrically-opposing fixed coupling member, the symmetrically-opposing fixed coupling member disposed on a symmetrically-opposing fixed mount disposed on a symmetrically-opposing forward lateral portion of the wheelchair, in a direction along a second, substantially horizontal line of insertion passing through the symmetrically-opposing fixed coupling member. In embodiments, the symmetrically-opposing fixed mount, the symmetrically-opposing releasable coupling member, and the symmetrically-opposing implement are each of mirror image form respective to the first fixed mount, the first releasable coupling member, and a first implement.

Embodiments of the present invention may, alternatively, be characterized as a unilateral attachment apparatus for a wheelchair, a first apparatus capable of attaching and deploying a first implement in a first predetermined orientation in conjunction with a first side of the wheelchair, a second similarly-configured apparatus capable of attaching and deploying a second implement in conjunction with a second side of the wheelchair, each individual apparatus comprising a fixed coupling member adapted to be affixed relative to one of the first side of the wheelchair or the second side of the wheelchair. Each individual apparatus comprises a separable coupling arrangement, such as with a receiver and an insertable member, wherein coupling of an implement with the fixed coupling member enables attachment of one of a plurality of implements to one of the first side of the wheelchair or to the second side of the wheelchair.

In an embodiment, the apparatus comprises a coupling and a joint, the apparatus being capable of deploying a first implement in a first predetermined orientation and in a first substantially extended position in conjunction with a front lateral portion of the wheelchair, the apparatus being further capable of deploying a second implement in a second predetermined orientation and in a second substantially extended position in conjunction with the first side of the wheelchair. Each substantially extended position may occupy an elevated location above the level of the seat of the wheelchair and a location out beyond the foremost portion of the wheelchair frame in a manner which substantially increases the effective height or the effective length, or both, of the combined wheelchair and implement. The joint is defined by a substantially horizontal lateral rotation axis about which the first implement and the second implement are capable of relative rotation in order to achieve deployment thereof. During attachment and connection of either implement, the joint remains operatively interposed between the wheelchair and the attached implement.

In a separable-type apparatus embodiment, a joint comprises separable rotary elements which are capable of coupling, wherein the joint is formed upon coupling of a fixed coupling member and a releasable coupling member to unify the whole apparatus with the wheelchair and to enable rotation of the releasable coupling member (and an implement attached thereto) relative to the fixed coupling member (and the frame of the wheelchair). Upon coupling of the fixed coupling member and the releasable coupling member, the union thereof defines the substantially horizontal lateral rotation axis of the joint; thus, in this case the joint and the coupling are the same entity, with the combined joint-coupling being operatively interposed between the wheelchair and the attached implement.

In an inseparable-type apparatus embodiment, a joint comprises inseparable rotary elements wherein opposing rotary parts of the joint itself remain assembled at all times, the joint being inseparably connected to one of the fixed coupling member or the releasable coupling member, with the substantially horizontal lateral rotation axis defined by the joint which exists as a distinct entity in relation to the coupling members. In a first example, having an inseparable-type joint inseparably connected to the fixed coupling member, the joint remains connected to the wheelchair at all times, wherein an attachable implement comprising the releasable coupling member is fully separable from the joint. In a second example, having an inseparable-type joint inseparably connected to the releasable coupling member, the joint remains connected to the attachable implement at all times, wherein the wheelchair comprises the fixed coupling member, the joint being fully separable from the wheelchair. In both examples, during attachment of the implement, the joint is operatively interposed between the wheelchair and the attached implement.

In another inseparable-type apparatus embodiment, a joint, comprising inseparable rotary elements as described above, is separably connected to both the fixed coupling member and the releasable coupling member, thus to operatively interpose the inseparable-type joint between the fixed coupling member and the releasable coupling member and to enable full separation of the joint from both the wheelchair and an implement; in this case, the joint may be utilized as a separate, universal component for use with one of a variety of implements as well as one of a variety of wheelchairs, if desired.

Other embodiments of the present invention may be characterized as a wheelchair comprising a fixed coupling member integrated with a forward frame portion of the wheelchair, the fixed coupling member being capable of coupling with a releasable coupling member, the releasable coupling member integrated with: A.) a first implement, or B.) a second implement, the wheelchair capable of coupling and operatively interposing the fixed coupling member and the releasable coupling member between the forward lateral portion of the wheelchair and the first implement or the second implement.

In an embodiment, a wheelchair is capable of operating in conjunction with a ground-contacting type implement during interposition thereof between the wheelchair and a ground surface beneath the wheelchair, the ground-contacting type implement being unilaterally connected to a first side of the wheelchair. Additionally, it may be desirable to unilaterally connect a second ground-contacting type implement to a second side of the wheelchair. Also, the wheelchair is capable of operating in conjunction with an elevated type implement during interposition thereof between the wheelchair and an auxiliary load, the elevated type implement being unilaterally connected to a first side of the wheelchair. Additionally, it may be desirable to unilaterally connect a second elevated type implement to a second side of the wheelchair. Without departing from the spirit of the present invention, it may be desirable to unilaterally connect a ground-contacting type implement to a first side of the wheelchair and to unilaterally connect an elevated type implement to a second side of the wheelchair.

Embodiments of the present invention may, lastly, be characterized as a method of configuring a universal connection system for a wheelchair, the universal connection system capable of adapting the wheelchair with a ground-contacting implement and an elevated type implement. The method may include any or all of adjusting, dimensioning, and positioning of the universal connection system to enable: A.) deployment of the ground-contacting implement in a first predetermined load-bearing position and interposition of the ground-contacting implement between a forward lateral portion of the wheelchair and a ground surface beneath the wheelchair, and B.) deployment of the elevated type implement in a second predetermined load-bearing position and interposition of the elevated type implement between the forward lateral portion of the wheelchair and an auxiliary load substantially elevated from the ground surface beneath the wheelchair.

It may be advantageous, for simplicity of manufacturing as well as for provisioning to an end user, to fashion a wheelchair for the future possibility of outfitting the wheelchair with a universal connection system. With that end in mind, the wheelchair may be constructed so that it comprises welded tabs, drilled apertures, flatted frame portions or other similar frame additions or modifications useful for the purpose of rigidly securing structures necessary to form a complete universal mounting system but which, for the time being, are minimally distinguishable in a visual sense from a wheelchair that has not been fashioned with these provisions.

Upon receiving an order for a reconfiguration system or apparatus according to the present invention, detailed measurements of the wheelchair may be required to fully inform the maker or retailer in properly selecting the tools to include in the delivered product to enable simple and correct installation. For example, to correctly install a universal connection system for use with a pair of adaptive caster wheel assemblies, installation must take into account a desired elevation of the primary caster wheels above the ground surface during deployment of the adaptive caster wheel assemblies. The primary caster wheels may, for example, be rested atop a block having a thickness equal to this desired elevation, and the mounting structures along with the adaptive pivotable caster wheel assemblies attached are then secured to the front frame tubes of the wheelchair such that both adaptive pivotable caster wheels are in equal contact with the ground surface. Instructions for further adjustments may be provided, such as to ensure that the pivot axis of the pivotable caster wheel assembly is substantially vertical and will trail properly.

An on-site computer numerical control (CNC) method of manufacturing individual components may be employed to fashion parts necessary for a complete assembly, with the added advantage of creating highly customized parts for a given wheelchair, whether performed at a wheelchair or after-market product manufacturing facility, a durable medical equipment dealership, in a hospital or other clinical setting, or by a user in his or her home, garage, or workshop.

Passing through the rotary latch mechanism assembly is a joint axis defining the union between the stationary portion of the rotary latch mechanism assembly and the rotatable portion of the rotary latch mechanism assembly. In other words, the rotary latch mechanism assembly forms a rotary joint at the union of the portion that is stationary relative to the wheelchair and the portion that is rotatable relative to the wheelchair.

In embodiments having the rotatable portion of the rotary latch mechanism assembly separable from the stationary portion thereof, the joint axis of the rotary joint may be one and the same as an insertion axis, wherein the joint is formed by coupling of the rotatable portion with the stationary portion, as an insertable member disposed on one is inserted into a receiver disposed on the other in a direction along the insertion axis.

Alternatively, embodiments may have the joint axis of the rotary joint may be different from a line of insertion, wherein the joint is distinct from any insertable coupling member or receiver capable of coupling to effectuate attachment of an implement to the wheelchair. In some cases, the joint axis of the rotary joint may be substantially parallel to the line of insertion; in other cases, the joint axis of the rotary joint may be substantially perpendicular to the line of insertion.

While outfitted on a wheelchair, the joint axis of the rotary latch mechanism assembly is substantially horizontal, but may be at least somewhat diagonal relative to a horizontal plane passing through the wheelchair. In fact, depending on the geometry of the front portion of the host wheelchair, diagonal attachment of the rotary latch mechanism assembly to the wheelchair may be unavoidable, and in the case of a wheelchair having a dramatic inward taper of the front down tubes, it may be necessary to include provision for adjustment of the orientation of the rotary latch mechanism assembly in order to achieve a substantially horizontal joint axis. Such orientation adjustment provision may be incorporated into the frame mount.

A bearing region, disposed on one of the stationary portion or the rotatable portion, is capable of rotating relative to a bearing post disposed on another of the stationary portion or the rotatable portion, about the joint axis passing through the rotary latch mechanism assembly. Further, throughout relative rotation about the joint axis, the bearing post and the bearing region are both maintained at a fixed radius from the joint axis.

In embodiments, the bearing post is circular and the bearing region is substantially arcuate. Upon the bearing post contacting the bearing region as a result of relative rotation between the stationary portion and the rotatable portion of the rotary latch mechanism assembly, contact is achieved between the bearing post and the bearing region along an arcuate interface zone. To achieve a strong, reliable, and play-free interface between the bearing post and the bearing region, it may be desirable for the bearing region to define an arc angle of at least about 15 degrees or 0.262 radians. Greater arc angles such as about 45 degrees or 0.785 radians, about 90 degrees or 1.57 radians, or about 120 degrees or 2.09 radians, may be preferred in order to maximize the arc length of the arcuate interface zone upon the bearing post contacting the bearing region.

In embodiments, it may be beneficial to dispose a retention member, such as a flange, on an outer end region of the bearing post, the retention member serving to prevent lateral movement of the implement relative to the mounting assembly during attachment and deployment. The retention member may, for example, be a circular flange having smooth, rounded edges and may be plastic or rubberized so as not to pose a hazard for abrasion or a risk of damaging finished surfaces such as on kitchen cabinetry, tables, or automobiles.

In preferred embodiments, the rotary latch mechanism assembly comprises a pivotable latch element that is pivotable about a pivot axis, the latch element being fabricated out of steel, stainless steel, titanium, aluminum, aluminum bronze, brass, plastic, thermo-softening plastic, carbon fiber, fiberglass, or the like. It may be preferable to fashion the pivotable latch element from plate material, so that it is substantially flat and comprises a bearing edge which, upon capturing of the bearing post in the bearing region and the pivotable latch element pivoting to assume a holding position, serves as a bearing surface. It may be preferable for the pivotable latch element to comprise a curved, arcuate, or otherwise contoured edge which facilitates relative movement against the bearing post and which also performs well at holding the bearing post in the seated position of the bearing region.

Ideally, upon the pivotable latch element pivoting into the holding position, very little or no rotary movement is permitted to occur about the joint axis of the rotary latch mechanism assembly. Conversely, upon the pivotable latch element being intentionally urged in a direction away from its holding position, such as by the user applying force against a lever handle connected to the pivotable latch element, sufficient rotary movement is permitted to occur about the joint axis of the rotary latch mechanism assembly to effectuate disengagement of the pivotable latch element and the bearing post.

In embodiments, the rotary latch mechanism assembly is configured with an engagement spring or engagement elastomer capable of providing a sustained urging force against the pivotable latch element. A ball, roller, or slider may be operatively interposed between the engagement spring and the pivotable latch element to facilitate smooth, reliable pivoting of the pivotable latch element; such a ball, roller, or slider may be composed of stainless steel, nylon, or other material exhibiting high lubricity, corrosion resistance, and longevity.

In embodiments configured with an engagement spring or engagement elastomer, a latch release bar, lever, or handle may be integrated therewith, such as being unified with and projecting from the pivotable latch element. Such latch release means enable a user to draw or bias the pivotable latch element away from its holding position to permit release of the bearing post from its seated position within the bearing region.

In embodiments, it may be preferable to utilize a clamp for affixing the stationary portion of the rotary latch mechanism assembly to the frame of the wheelchair; parallel-mounting type clamps such as those commonly used to affix wheel locks ("brakes") to a wheelchair frame, may be utilized to secure a cylindrical portion of the modular apparatus to a front "down-tube" of the wheelchair frame. Examples of parallel-mounting type clamps of this sort are those sold by Out-Front (Mesa, Ariz.) and Melrose USA (Fresno, Calif.), which are made in a variety of sizes and also accommodate 1", 1.125", and 1.25" tube diameters. Some wheelchairs, such as those manufactured by KiMobility, Stevens Point, Wis., employ "oversized" aluminum tube for frame construction, such as 1.375" in diameter, and thus require a mounting clamp adapted to affix to a tube of such diameter.

To facilitate clamping to a variety of tube diameters using a single size mounting clamp, cylindrical shims or pairs of half-cylinder shims may be utilized wherein, for example, a 1.25" mounting clamp is secured over a shim pair having a 1.25" outer diameter and a 1.125" inner diameter, the shim pair being configured to fit snugly around a wheelchair front down-tube having a 1.125" outer diameter. Such shims may be composed of steel, aluminum, titanium, carbon fiber, polycarbonate, or other such rigid materials, and are preferably machined and finished to facilitate a secure grip over the wheelchair front down-tube upon tightening the clamp, while also preventing marring of the original finish of the wheelchair frame. In order to include accommodations for "oversized" 1.375" diameter frame tubing, it may instead be desirable to fashion a 1.375" clamp and provide shims having the correct thickness to adapt the 1.375" clamp to a 1.25", 1.125", or 1" frame tube.

Embodiments may comprise a frame mount which is welded, bonded, cemented, glued or otherwise permanently secured to the frame of the wheelchair and which allows the user to couple and decouple both the rotary latch mechanism assembly and the adaptive implement to and from the permanently-secured frame mount or, alternatively, which allows the user to couple and decouple the adaptive implement to and from a portion of the rotary latch mechanism assembly while the rotary latch mechanism assembly remains secured to the permanently-secured frame mount.

Other embodiments may comprise an adjustably affixed frame mount which is semi-permanently clamped, bolted or otherwise adjustably affixed to the frame of the wheelchair and which allows the user to couple and decouple the rotary latch mechanism assembly to and from the adjustably affixed frame mount or, alternatively, which allows the user to couple and decouple the implement to and from a rotatable portion of the rotary latch mechanism assembly while the rotary latch mechanism assembly remains secured to the adjustably affixed frame mount. The adjustably affixed frame mount may include means to permit angular or height adjustments of the positioning of the frame mount (and thus the positioning of an implement while attached), especially in a manner which achieves a substantially horizontal orientation of the rotation axis of the joint formed by the rotary latch mechanism assembly.

To enhance the grip of a frame mounting clamp around a frame tube of the wheelchair, it may be useful to apply a rubberized, sanded, or cementitious paste, liquid, gel, or tape therebetween, preferably in a manner which does not scratch, mar or otherwise alter the finished outer surface of the wheelchair frame tube.

Embodiments may include a coupling for releasably connecting one of a plurality of different implement types to the rotatable portion of the rotary latch mechanism assembly. Ideally, an attach-release coupling is configured for maximum distribution of forces, particularly torque borne about the axis of the joint of the rotary latch mechanism assembly, as well as for reliable fixation of an attachable implement, while requiring minimal hand or wrist function to secure and release the attachable implement relative to the mount assembly. Connection may be achieved, for example, by lateral insertion of a male coupling pin or similar projection, disposed on an attaching end of the implement, into a receptacle or, in an opposite arrangement, by lateral sliding of a receptacle over a male coupling pin or similar projection. Alternatively, connection may be achieved by inserting or relative sliding of coupling members in a forward, upward, downward or diagonal direction to achieve a secure connection between coupling members. Such a coupling may include quick-release means such as a ball-detent insertion pin, such as that described in U.S. Pat. No. 3,101,641 "Adjustable Ball Pin" or, alternatively, a cam-lever constricting tube clamp, such as that commonly used for adjustably securing a bicycle seat post. Such a coupling may be configured with a non-circular mating region, such as a spline, square, or hexagon shape, or a keyway or key element, to ensure that relative movement or rotation is minimized upon insertion of a male portion of the coupling into a female portion thereof and, ideally, all wiggle or "play" is eliminate altogether upon tightening of the cam-lever constricting tube clamp.

In an embodiment, a coupling may include two ball-detent insertion pins configured to insert into two separate receptacles to provide a precisely-aligned and secure union between the attachable implement and the rotatable portion of the rotary latch mechanism assembly. In another embodiment, a non-circular mating region may be combined with a quick-release means such as a ball-detent insertion pin to facilitate connection of the opposing coupling members and to minimize relative movement or rotation upon connection thereof.

Positive locking of a coupling may be required for ground-contacting applications and for other applications wherein the wheelchair and or the attachable implement is subjected to mechanical shock, torque, pull, vibration, or the like, which may have the effect of separating the male coupling member from the female coupling member. A positive locking ball-detent pin, for example, is a well-accepted securing means, as it is a commonly employed means for attaching rear drive wheels to a wheelchair: the user depresses a spring-loaded button to enable one or more detent balls to move out of position to allow separation of the pin from the receptacle with which it couples. For users having impaired hand or wrist function, such as people who have quadriplegia due to a cervical spinal cord injury, it may be especially useful to include a "quad-release" actuation lever wherein, rather than depressing a button to separate the pin from the receptacle, the user changes position of a lever to perform the same function, but with minimal dexterity.

In embodiments, it may be beneficial to include a secondary connection to the frame of the wheelchair, such as that illustrated in U.S. patent application Ser. No. 14/975,999, wherein a cam-lever assembly disposed on an extension arm of an implement serves as a rotation-limiter to stop or restrict rotation of the rotatable portion of the apparatus at a pre-determined angle. Such a secondary frame connection also enables the user to apply reverse-directed tension or pressure between the implement and the frame of the wheelchair to substantially increase the rigidity of the implement in its union with the wheelchair. For example, rotation of an eccentrically-mounted cam wheel imparts reverse-tension against the frame of the wheelchair and serves as a secondary connection thereto, the cam wheel comprising a highly-lubricious, yet slightly deformable surface which contacts the wheelchair frame to confer both smooth action and prevention of accidental or unwanted slippage. The cam wheel, in this example, has an attached lever handle connected thereto at a location which, upon rotation by the user to apply reverse-directed tension against the frame of the wheelchair and exhibits an over-center action, "snapping" into an over-center position. Release of the reverse-directed tension is only achieved by "snapping" the lever handle out of the over-center position. Such provisions adds safety, in that the added step of releasing or disengaging the secondary connection means serves to prevent accidental disengagement of the rotary latch mechanism assembly.

Other secondary connection means may include a device such as a clamp, latch, hasp, clip, catch, or the like, also for the purpose of substantially reducing or eliminating "play" or wiggle of the rotatable portion of the device relative to the frame of the wheelchair, thereby conferring a secure, unified connection therebetween.

DETAILED DESCRIPTION OF THE INVENTION

The drawings described hereinafter are intended for the purpose of illustration rather than limitation.

To facilitate understanding of the figures, when appropriate, structural elements located on the right side of the wheelchair as well as any attachments thereto, from the perspective of an occupant of the wheelchair, have been labeled with the suffix "R" following the numeral corresponding to the structural element. Similarly, when appropriate, structural elements located on the left side of the wheelchair and any attachments thereto have been labeled with the suffix "L" following the numeral corresponding to the structural element. In cases where the aforementioned labeling convention does not aid in understanding a particular figure, the suffix has been omitted and only the numeral has been used. For example, the left-side rear drive wheel is referred to by label "120L," and the right-side rear drive wheel is referred to by label "120R." However, in a side-view illustration wherein 120L cannot be visibly distinguished from 120R, the rear drive wheels are collectively referred to by using label "120." Similarly, in some illustrations, the figure may be sufficiently clear and easily understood without the need to distinguish between left-sided elements and right-sided ones; in such cases the "L" and "R" naming convention is not utilized.

Figure 1A:
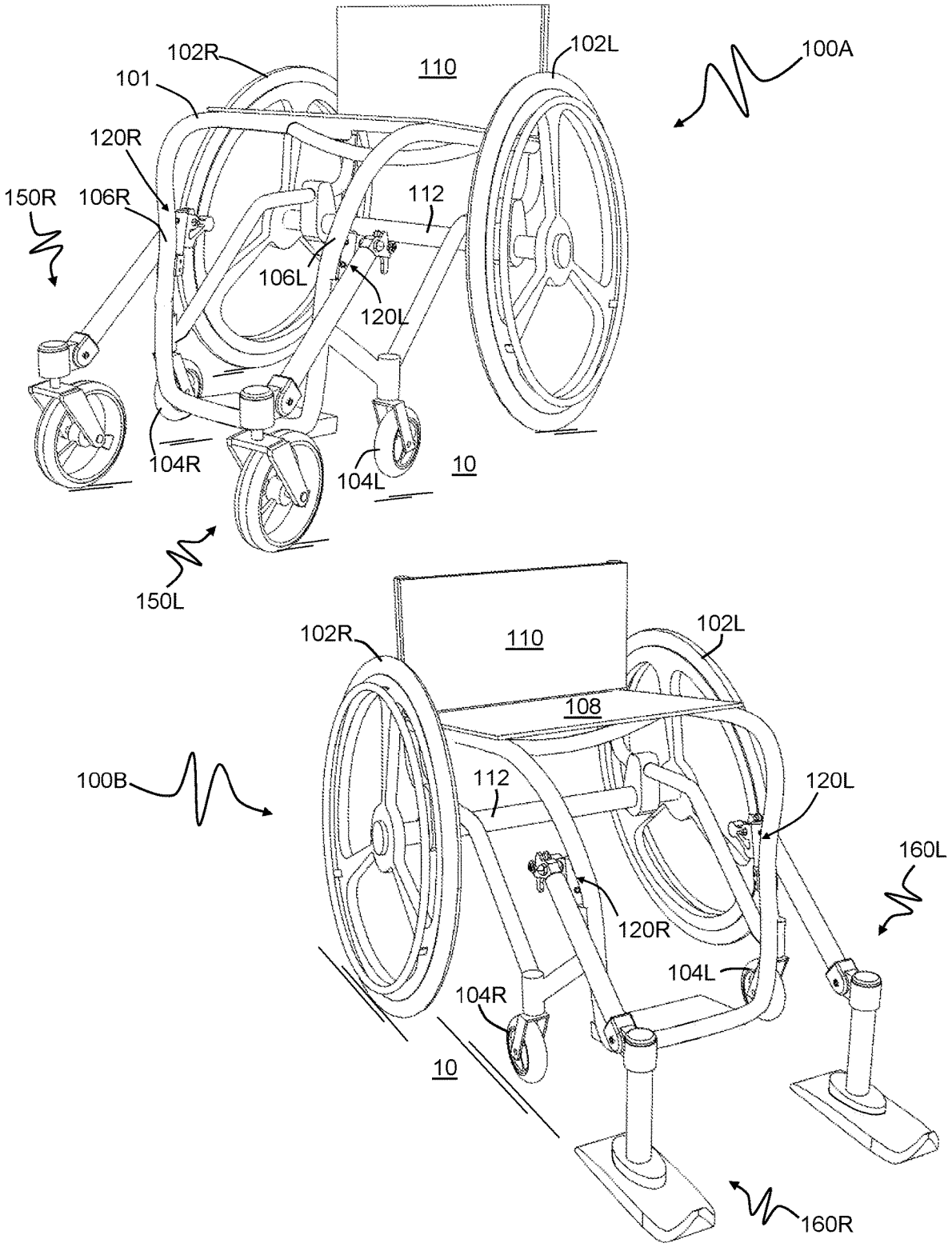
FIGS. 1A and 1B illustrate a system capable of attaching and deploying a plurality of ground-contacting adaptive implements and a plurality of elevated type adaptive implements.
Figure 1B:
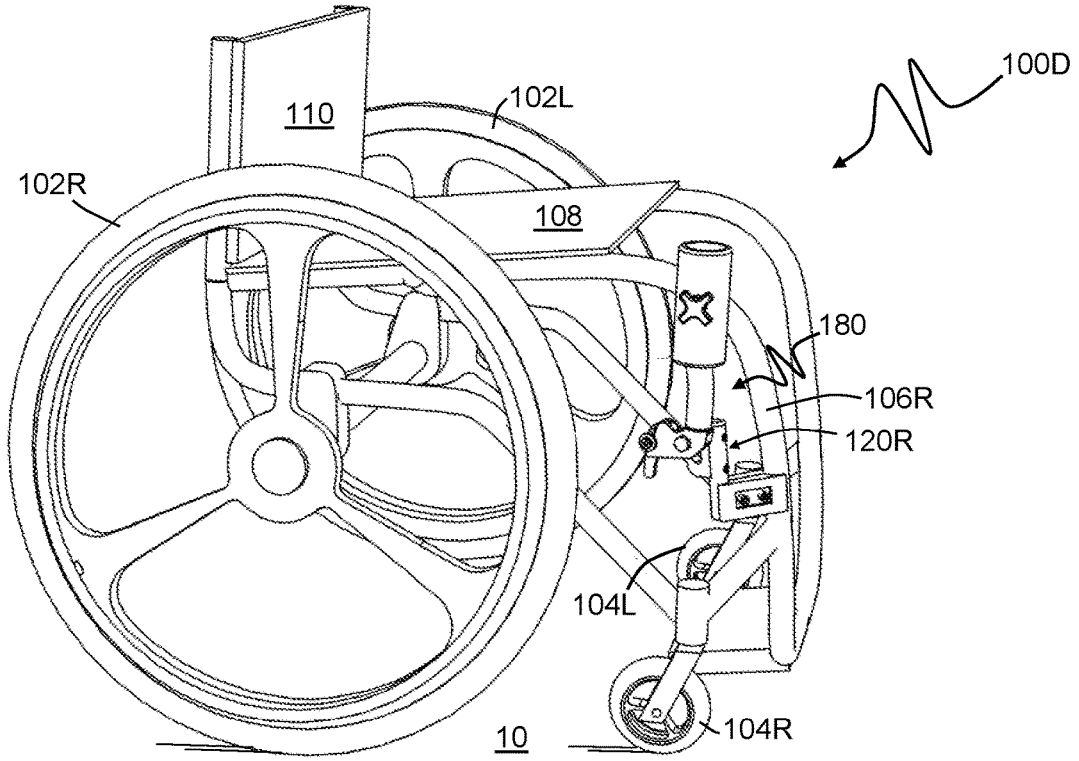
Figure 1B:
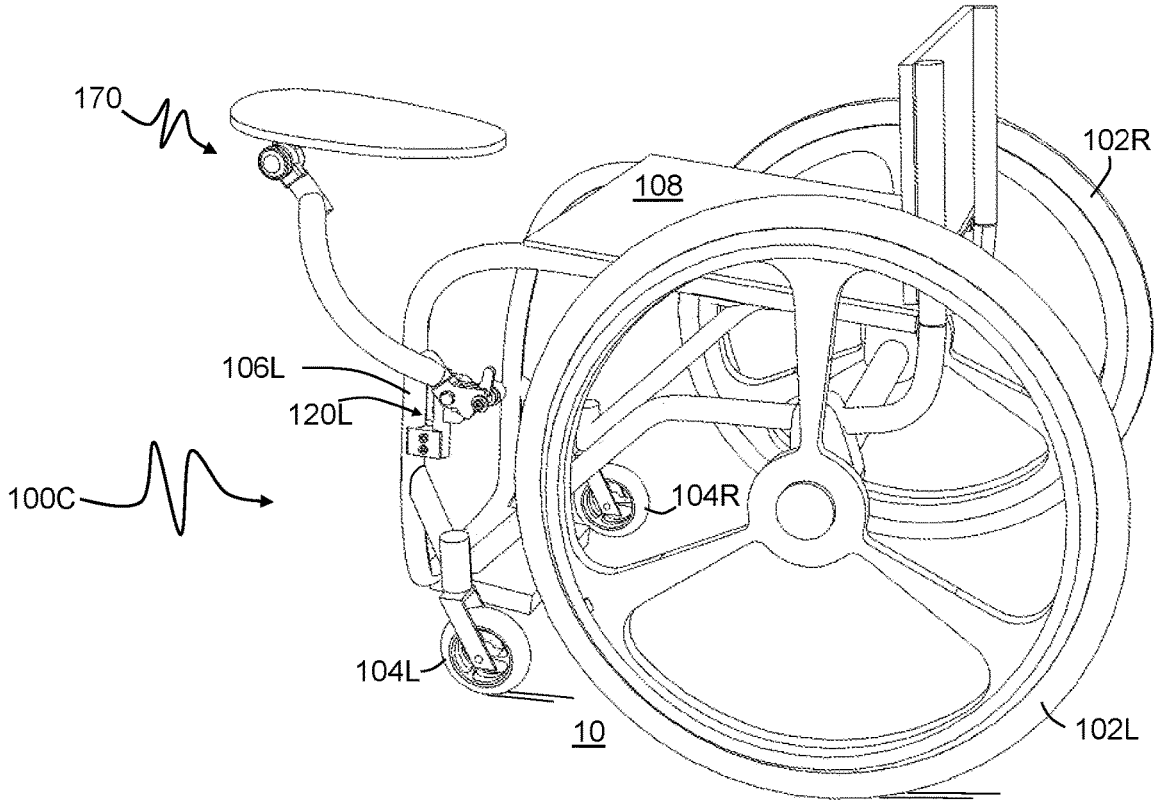

FIGS. 1A and 1B present an embodiment of the invention that is operable as a system capable of transforming the wheelchair among a plurality of configurations such as those described above, including outfitting the wheelchair with ground-contacting adaptive implements as well as elevated type adaptive implements. In FIG. 1A, wheelchair 100A comprises frame 101, rear drive wheels 102L and 102R, axle 112, primary caster wheels 104L and 104R, front down tubes 106L and 106R, seat 108, and back support 110. Wheelchair 100A is outfitted with frame mount assemblies 120L and 120R clamped to forward front down tubes 106L and 106R of wheelchair 100A. Dual, symmetrically-opposing caster wheel implements 150L and 150R are shown deployed, with primary caster wheels 104L and 104R substantially elevated from contact with ground surface 10 beneath the wheelchair. Wheelchair 100B, which comprises the same elements as wheelchair 100A and which is outfitted with the same frame mount assemblies 120L and 120R, is shown having dual, symmetrically-opposing ski implements 160L and 160R deployed, with primary caster wheels 104L and 104R substantially elevated from contact with ground surface 10 beneath the wheelchair.

In FIG. 1B, wheelchair 100C, which comprises the same elements as wheelchairs 100A and 100B, is outfitted with frame mount assembly 120L clamped to forward front down tube 106L, without any frame mount assembly attached to opposing forward front down tube 106R. A single, upwardly-rotating elevated work surface implement 170 is shown deployed, with primary caster wheels 104L and 104R fully contacting ground surface 10. Wheelchair 100D, which comprises the same elements as wheelchairs 100A, 100B, and 100C, is outfitted with frame mount assembly 120R clamped to forward front down tube 106R, without any frame mount assembly attached to opposing forward front down tube 106L A single, downwardly-rotating elevated utility holder implement 180 is shown deployed, with primary caster wheels 104L and 104R fully contacting ground surface 10. Thus, wheelchairs 100A, 100B, 100C, and 100D, all comprising substantially similar structures and frame geometries, may be outfitted with one or both frame mount assemblies 120L and 120R to enable a variety of ground-contacting and elevated type functionalities.

Figure 2A:
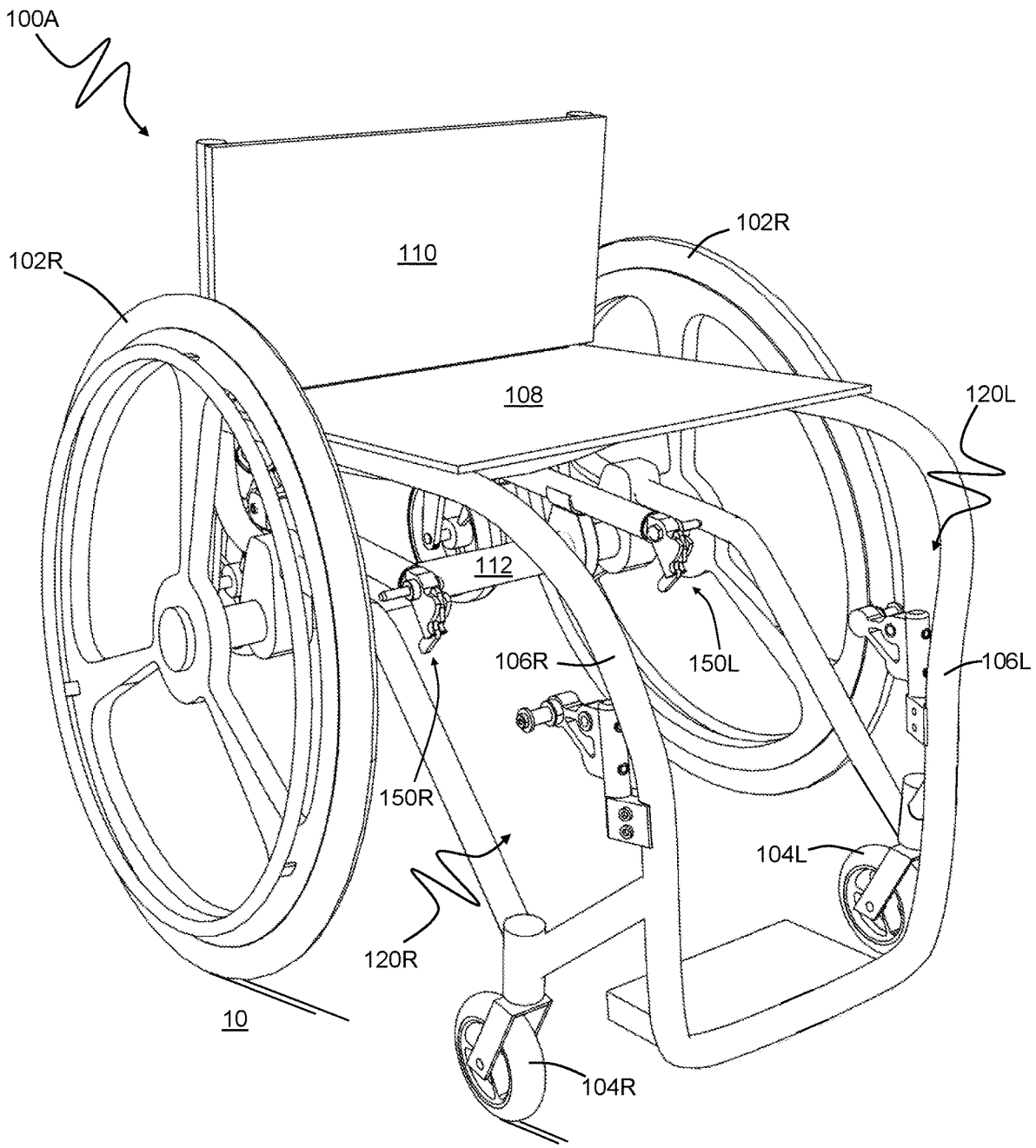
FIGS. 2A and 2B show a wheelchair capable of stowing dual ground-contacting adaptive implements beneath the seat of the wheelchair and attaching said adaptive implement above the rear axle, the dual ground-contacting adaptive implements capable of being attached and deployed to dual (left and right) front frame mounts disposed on the left and right sides of the front of the wheelchair (on the front down tubes of the wheelchair frame).
Figure 2B:
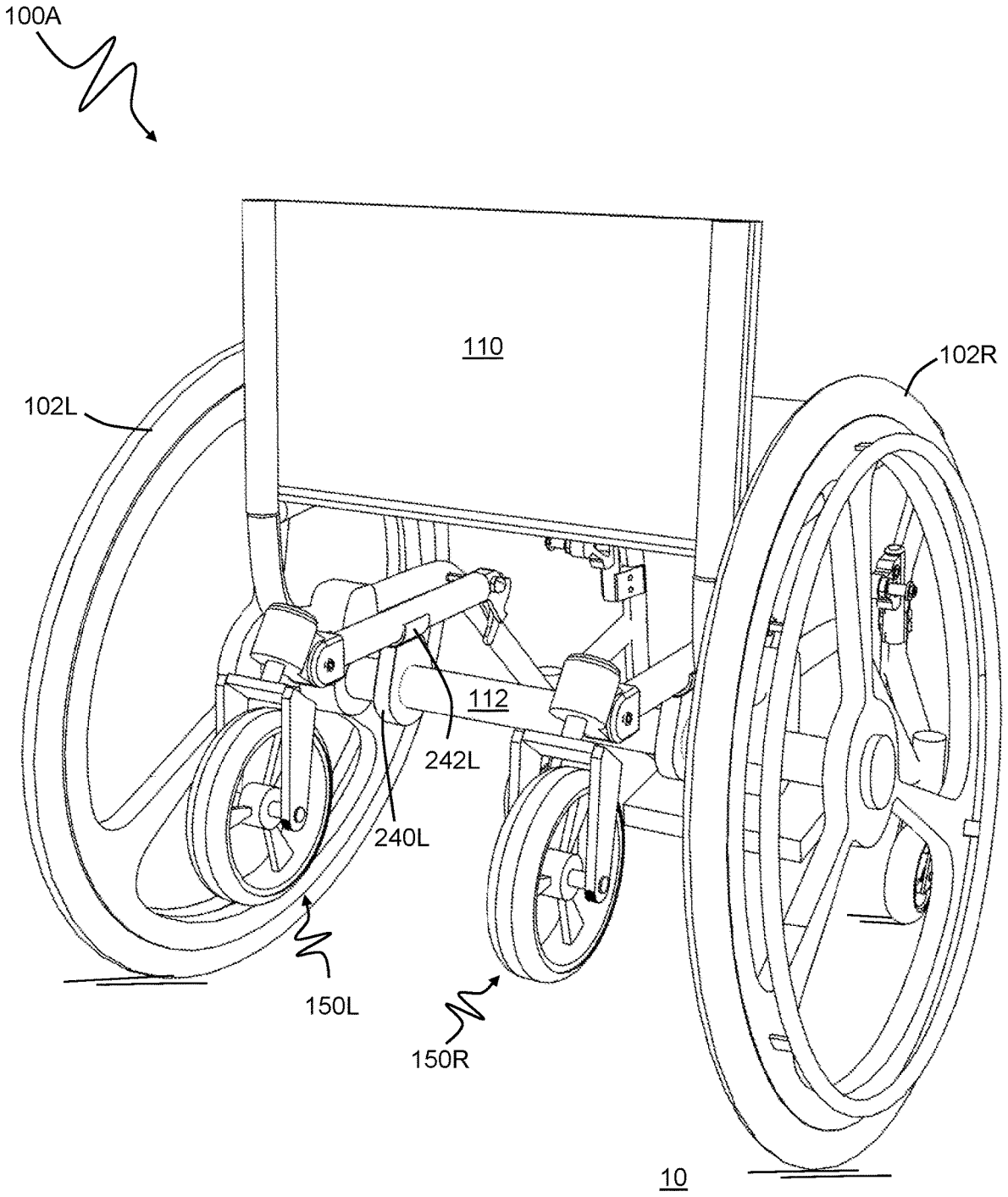
Figure 2C:
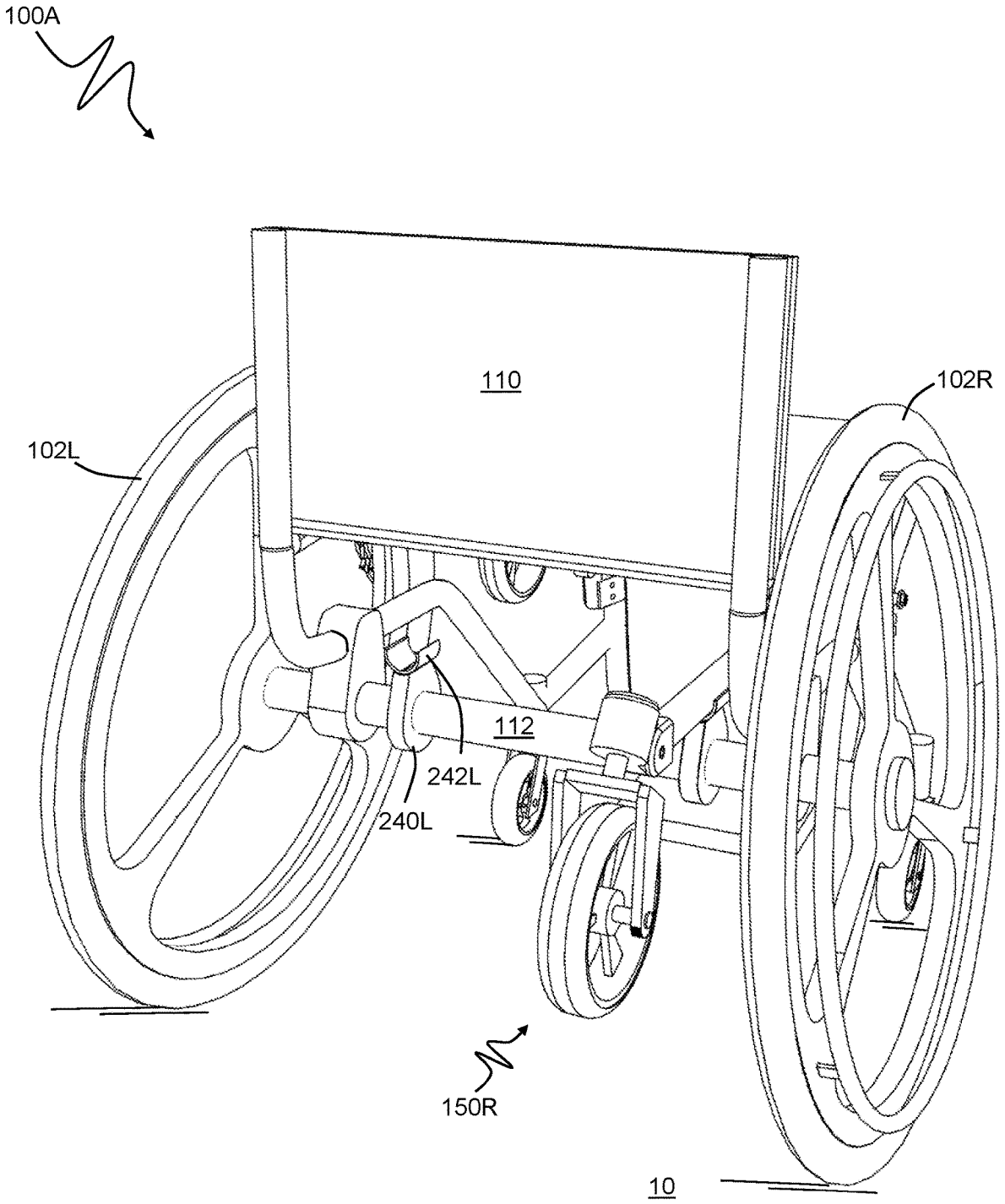
FIGS. 2C and 2D show the wheelchair having the left-side caster wheel implement removed from the stowed location beneath the seat of the wheelchair and, at a location to the left of the wheelchair, ready for connection to the frame mount disposed on the left side of the front of the wheelchair.
Figure 2D:
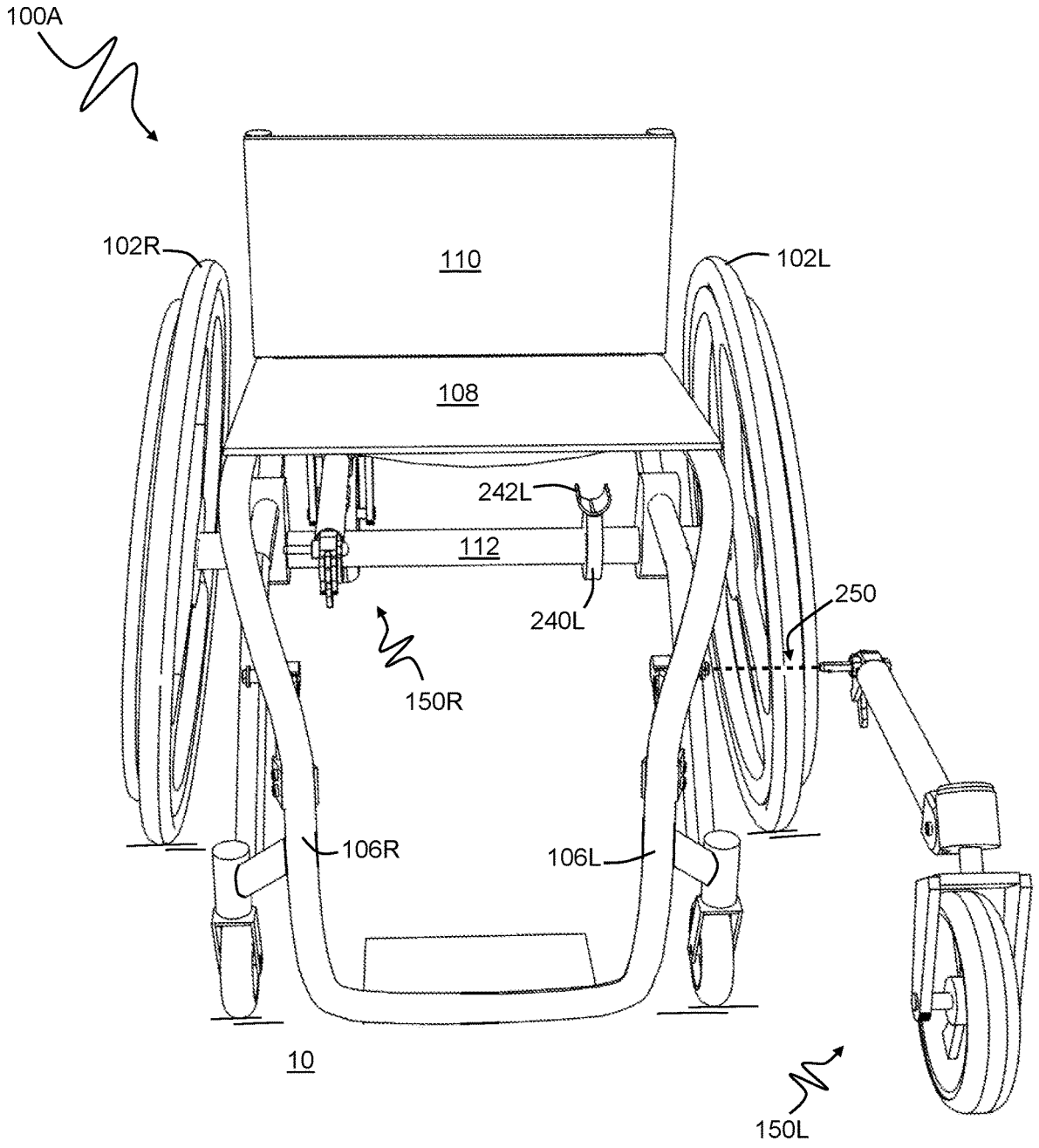

FIG. 2A shows wheelchair 100A outfitted with frame mount assemblies 120L and 120R, with caster wheel implements 150L and 150R in a stowed position beneath the seat 108 and above the axle 112. FIG. 2B is rear view of the wheelchair, showing caster wheel implements 150L and 150R in the stowed position. Stowing clip 242L, fastened to stowing clip support 240L secures caster wheel implement 150L relative to the wheelchair 100A with substantial clearance between the caster wheel implement 150L and the ground surface 10. FIG. 2C is a rear view of the wheelchair, showing caster wheel implement 150R in the stowed position and opposing caster wheel implement 150L removed from the stowed position, thereby leaving stowing clip 242L unoccupied. FIG. 2D is a front view of wheelchair 100A having stowing clip 242L unoccupied and having caster wheel implement 150L ready for attachment to frame mount assembly 120L along insertion line 250.

Figure 3A:
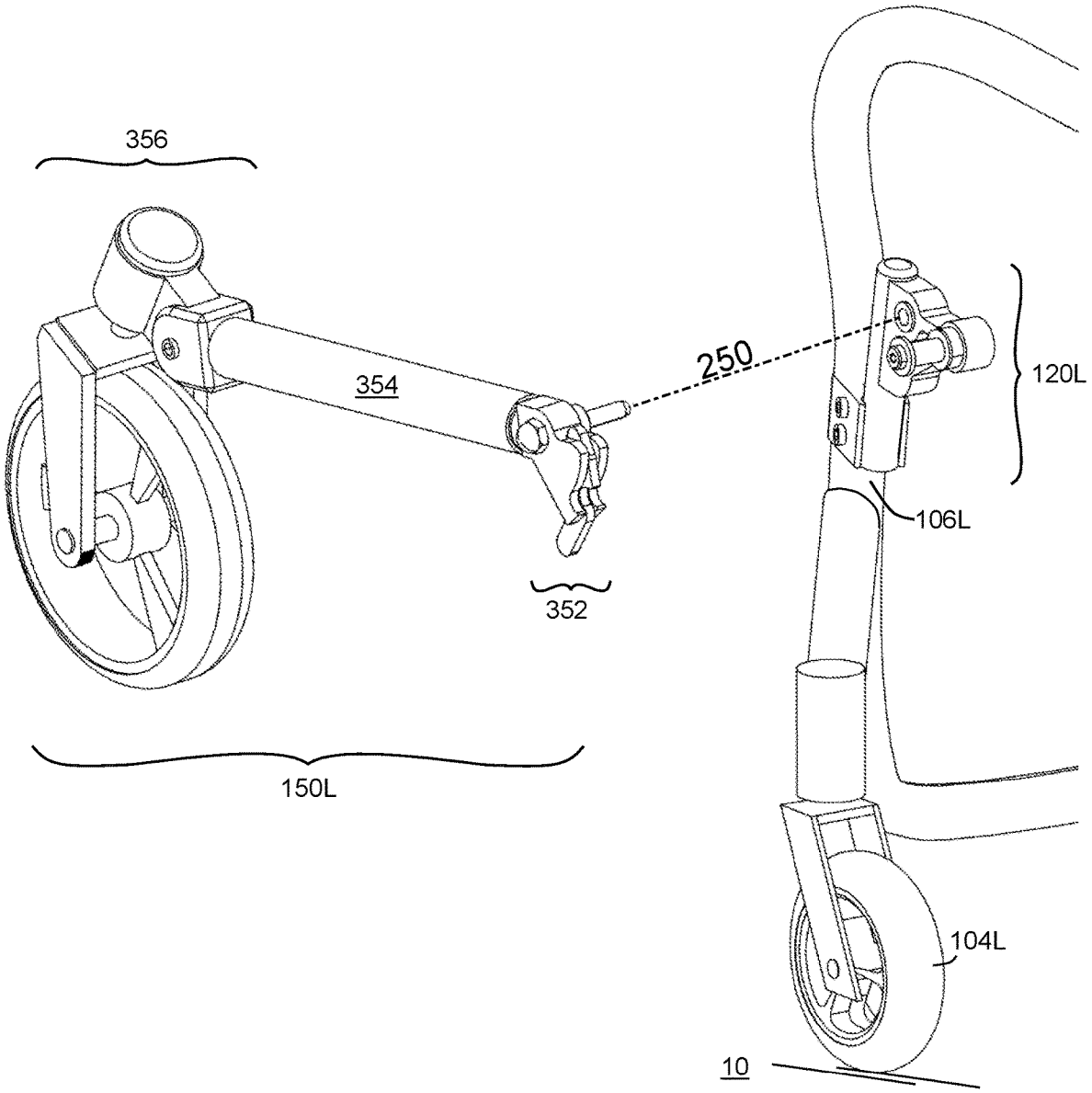
FIGS. 3A-3D show close-up views which illustrate how the left-sided ground-contacting adaptive implement is capable of coupling with the left-sided front frame mount.
Figure 3B:
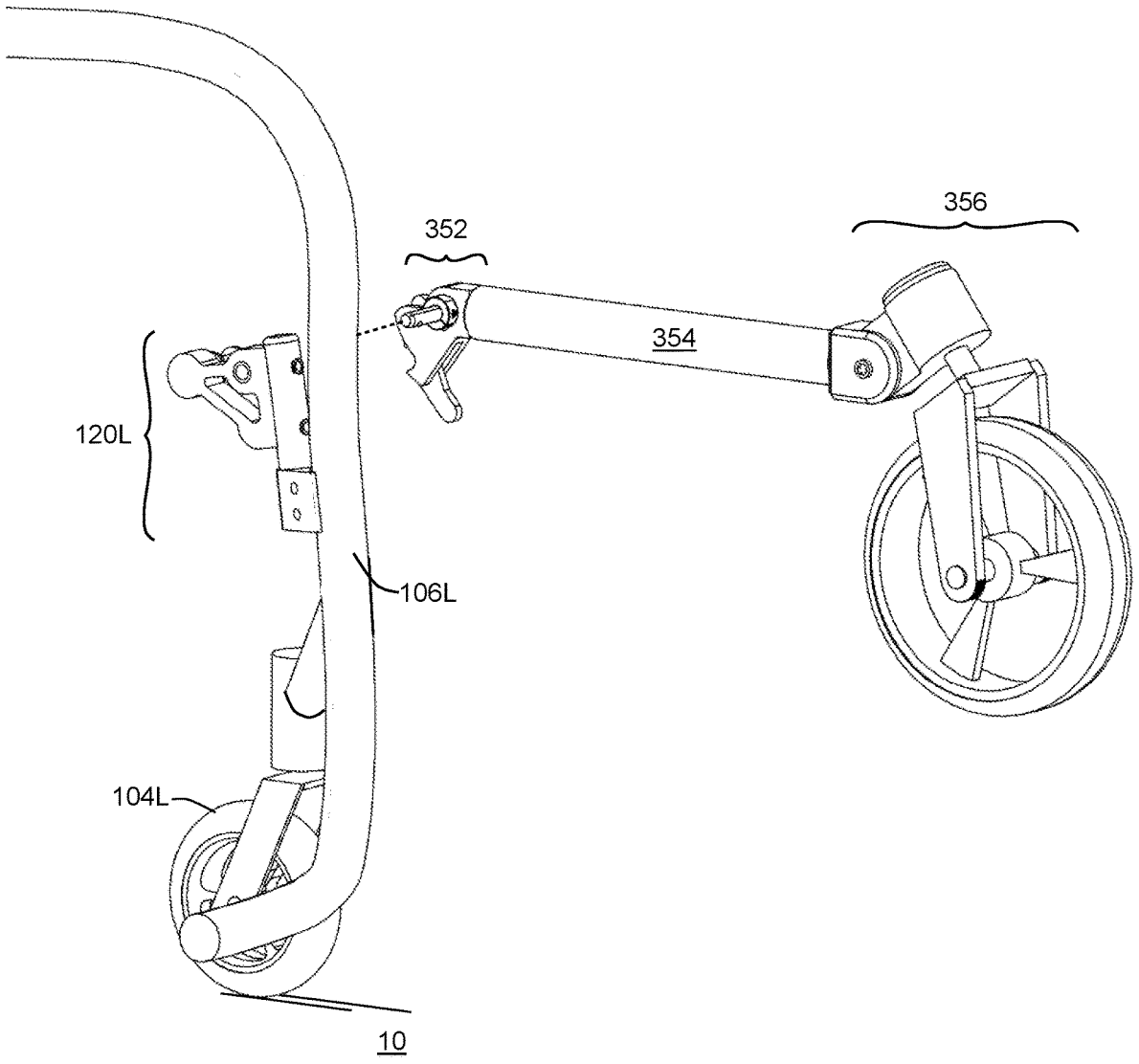

In FIGS. 3A and 3B, caster wheel implement 150L, is shown ready for attachment to frame mount assembly 120L along insertion line 250. Caster wheel implement 150L comprises rotary latch mechanism assembly 352 connected to a first end of tubular arm 354. Connected to a second end of tubular arm is pivotable caster assembly 356.

Figure 3C:
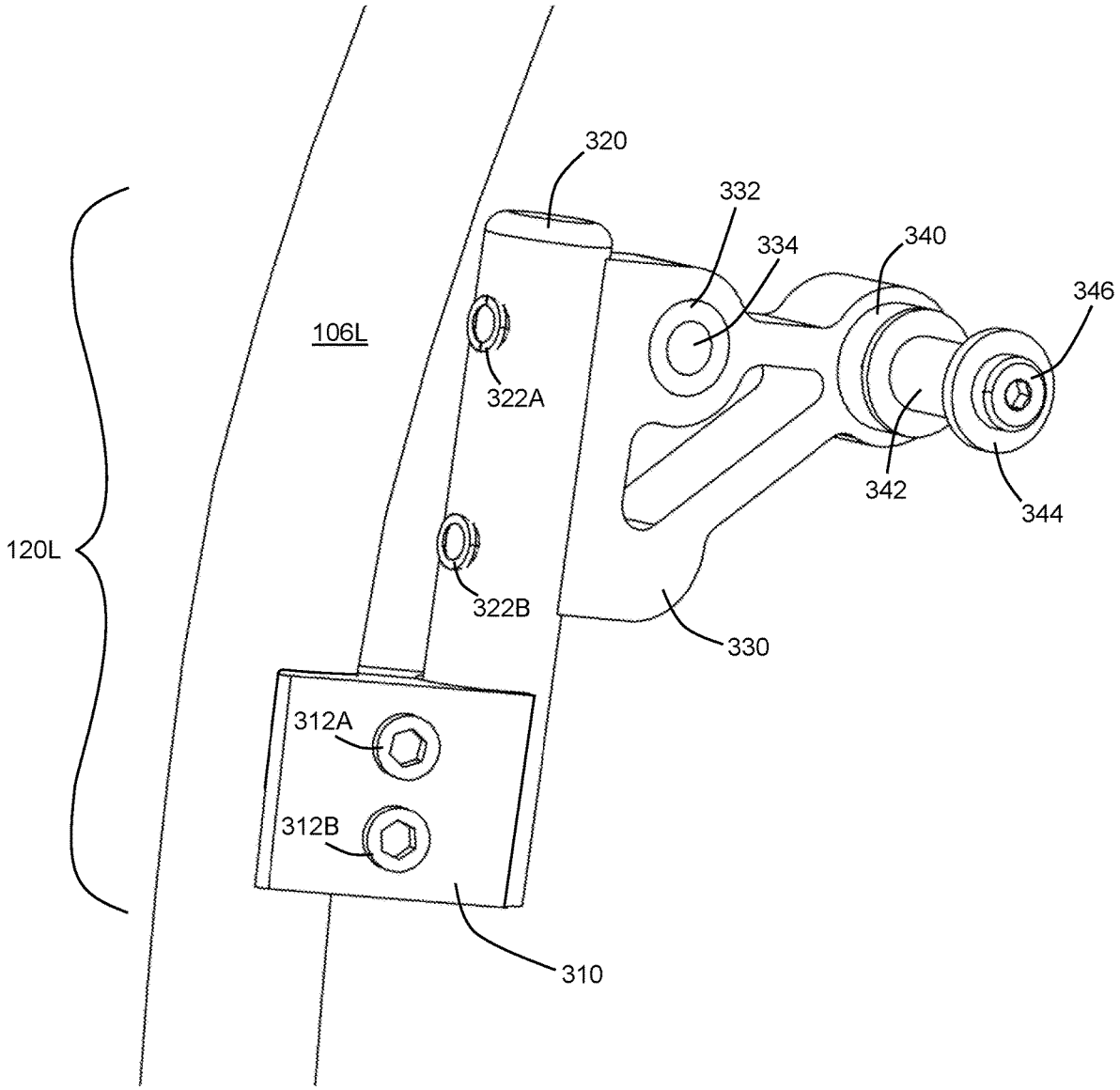

FIG. 3C shows a close-up view of frame mount assembly 120L and its attachment to front down tube 106L using parallel clamp 310. Upon turning upper fastener 312A and lower fastener 312B clockwise, parallel clamp 310 secures adjustment support rod 320 in a vertical and rotational orientation; this arrangement permits adjustability of the orientation of the frame mount assembly 120L relative to the wheelchair, ultimately enabling adjustment of the deployed position of an attached implement, in this case the caster wheel implement 150L (not visible), relative to the wheelchair. Adjustment support rod 320 is rigidly fastened by upper fastener 322A and lower fastener 322B to support body 330. Bearing post 342 comprising retention flange 344 is rigidly fastened by bearing post fastener 346 to support body 330, with a desired distance of separation being maintained between bearing post 342 and support body 330 by spacer 340. Flanged sleeve bearing 332 having receptacle 334 is secured (press-fitted or cemented) within an aperture drilled or otherwise formed into support body 330. Receptacle 334 receives an insertion pin (shown in FIG. 3D); thus, flanged sleeve bearing 332 serves as a fixed coupling member capable of coupling with a releasable coupling member (the insert pin).

Figure 3D:
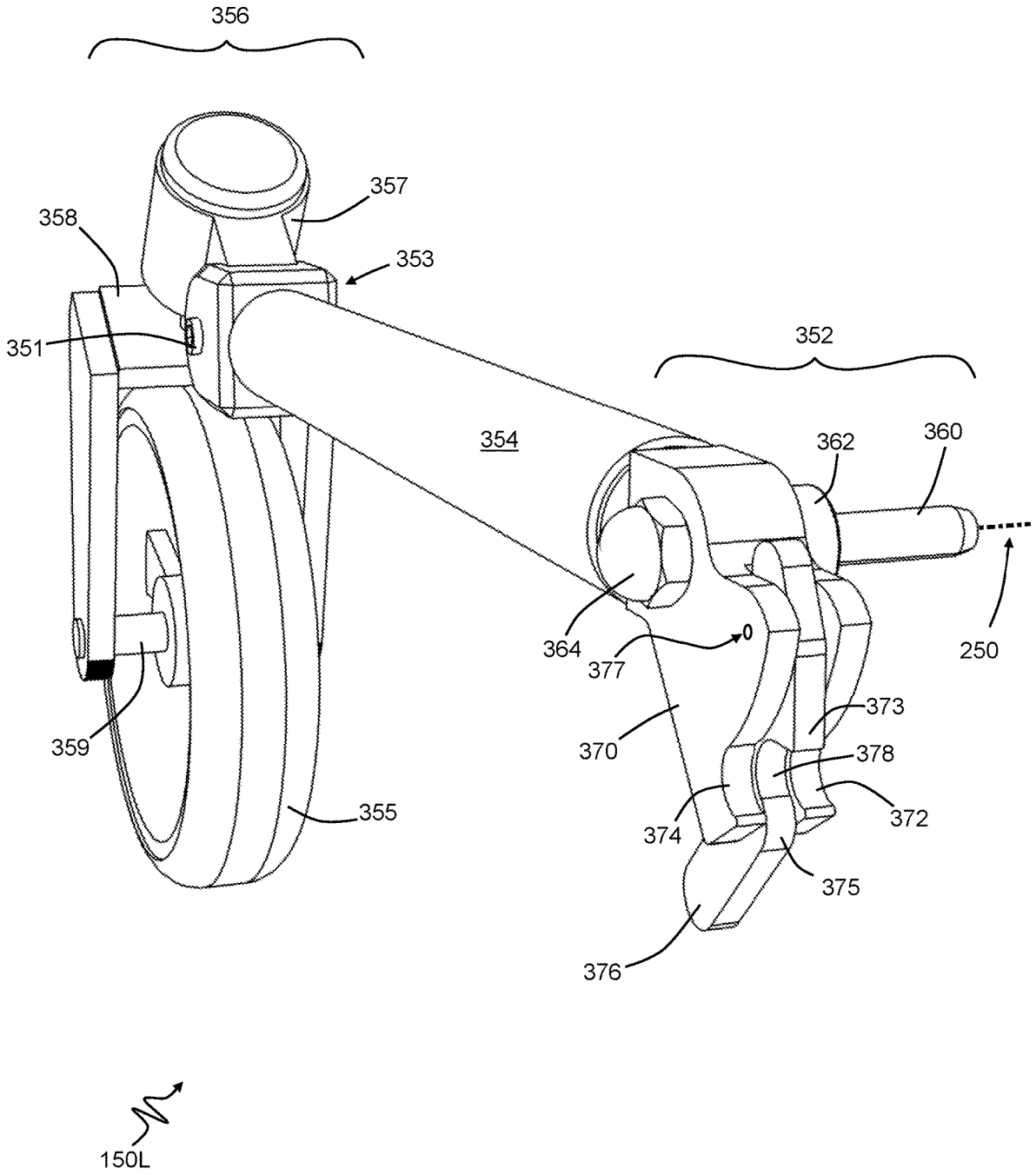

The close-up view of caster wheel implement 150L in FIG. 3D illustrates greater detail of caster wheel assembly 356 and rotary latch mechanism assembly 352, with tubular arm 354 interposed therebetween. Caster wheel assembly 356 comprises wheel 355 which is captivated within fork 358 by caster axle 359. Bearing housing 357 contains at least one rotary bearing (not visible) which permits rotation of the fork 358 about a caster pivot axis which is substantially vertical during deployment of caster wheel implement 150L. In order to achieve a vertical orientation of the caster pivot axis, angle adjustment joint 353 may be adjusted by way of loosening of fastener bolt 351, rotating fork 358 about a rotation axis passing through angle adjustment joint 353. Projecting though the body 370 of rotary latch mechanism assembly 352 is insertion pin 360, which is secured in position by spacer-clamp 362 on the inner side of the body 370 and by dome nut 364. Pivotable latch element 375, comprising handle end 376 and arcuate bearing surface 378, is captivated centrally within the body 370 and is capable of pivoting about a pivot axis defined by pin 377 projecting through the body 370 and the pivotable latch element 375. The body 370 comprises inner arcuate bearing surface 372 and outer arcuate bearing surface 374. The rotary latch mechanism assembly 352 further comprises striker projection 373 and arcuate bearing surface 378. Arcuate bearing surfaces 372, 374, and 378 are formed to have substantially the same radii as the radius of bearing post 342 (presented in FIG. 3C.).

Upon coupling of insertion pin 360 with receptacle 334 (presented in FIG. 3C.) and downward rotation of caster wheel implement 150L as a result of the user reclining the wheelchair 100A to substantially elevate primary caster wheels 104L and 104R, striker projection 373 contacts bearing post 342, with pivotable latch element 375 rotating inwardly, until downward rotation of caster wheel implement 150L relative to mount assembly 120L (and wheelchair 100) about insertion line 250 effectuates nesting of bearing post 342 against arcuate bearing surfaces 372 and 374 to stop further downward rotation of caster wheel implement 150L. Next, pivotable latch element 375 pivots outwardly to effectuate nesting of bearing post 342 against arcuate bearing surface 378 of pivotable latch element 375, accompanied by an audible "click" as pivotable latch element 375 quickly rotates back into its outermost orientation. Striker projection 373 now inhibits upward rotation of caster wheel implement 150L and maintains the wheelchair in a reclined orientation having primary caster wheels 104L and 104R (not visible) remaining elevated.

Figure 3E:
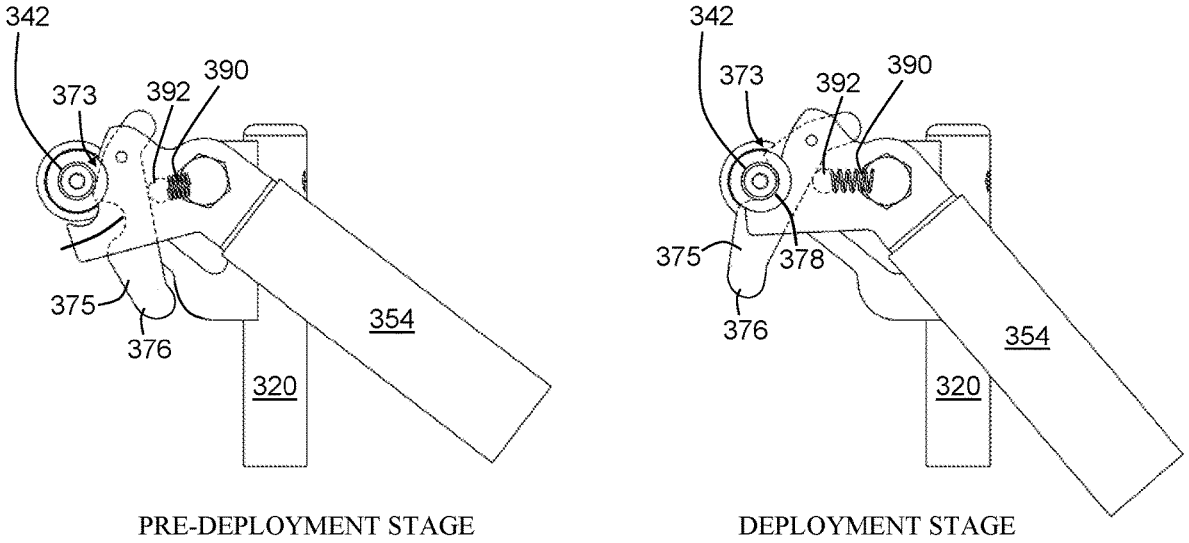
FIG. 3E shows how the left-sided ground-contacting adaptive implement is capable of deploying in a rotary fashion and illustrates how the internal compression spring and spherical bearing are positioned during pre-deployment and deployment.

The action just described is further illustrated in FIG. 3E, which shows how the positioning of pivotable latch element 375 changes as caster wheel implement 150L is rotated downward (effectively decreasing the angle formed by the adjustment support rod 320 of mount assembly 120L and tubular arm 354 of the caster wheel implement 150L during transitioning from a pre-deployment stage to a deployment stage. Also indicated in FIG. 3E is spring 390 as it becomes deflected (compressed) upon inward rotation of pivotable latch element 375 during the pre-deployment stage. Force is transmitted between spring 390 and pivotable latch element 375 through sphere 392. Upon full downward rotation of tubular arm 354, pivotable latch element 375 is permitted to pivot outwardly, thereby permitting relaxation (extension) of spring 390.

By pushing inwardly against handle end 376 of pivotable latch element 375 to compress spring 390, the user is able to disengage the arcuate bearing surface 378 from bearing post 342, thereby permitting disengagement and upward rotation of the caster wheel implement 150L relative to the wheelchair 100A.

Figure 4A:
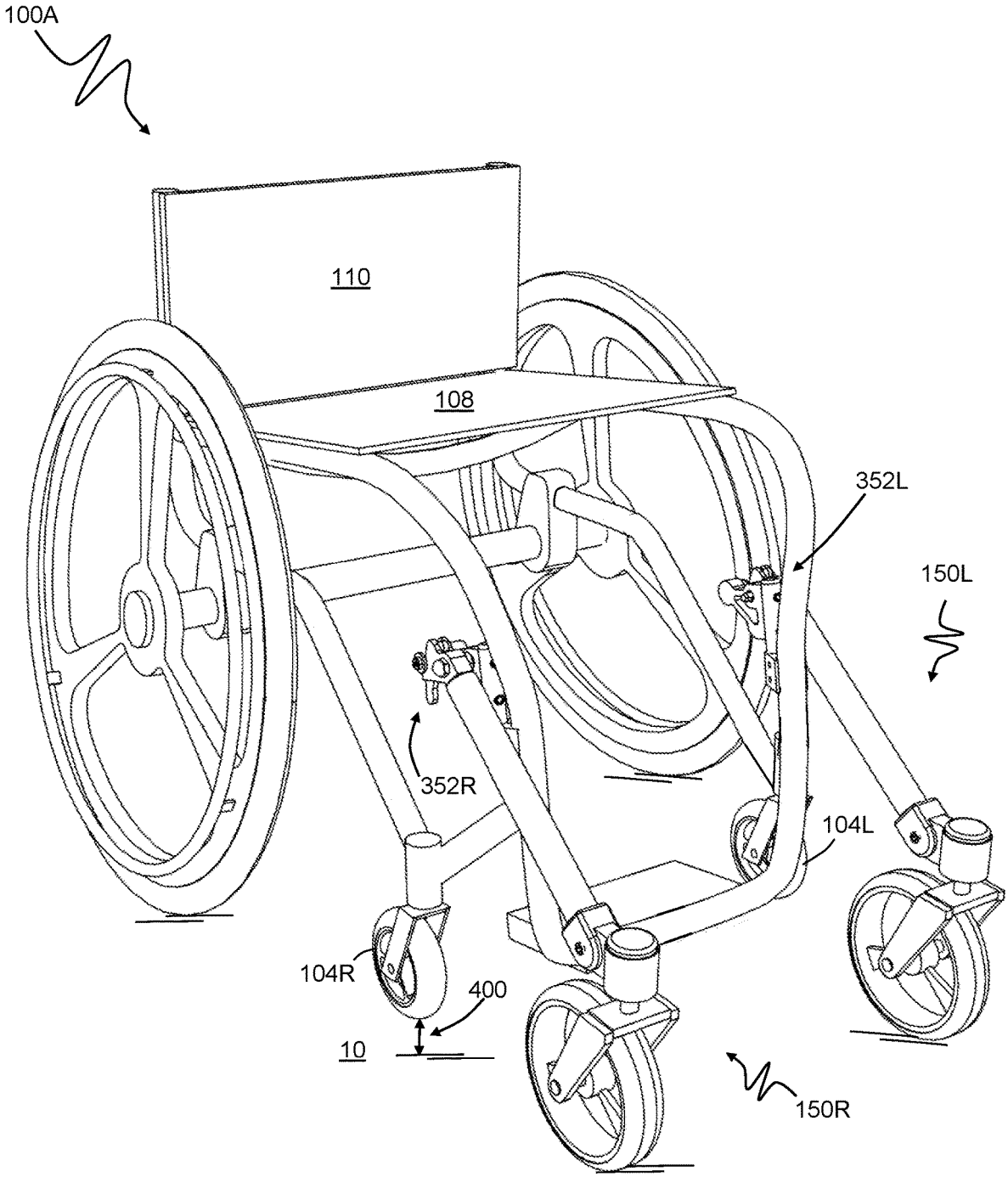
FIG. 4A shows the wheelchair having dual elevated type adaptive implements attached and deployed, with the front (primary) caster wheels of the wheelchair elevated from contact with the ground surface.
Figure 4B:
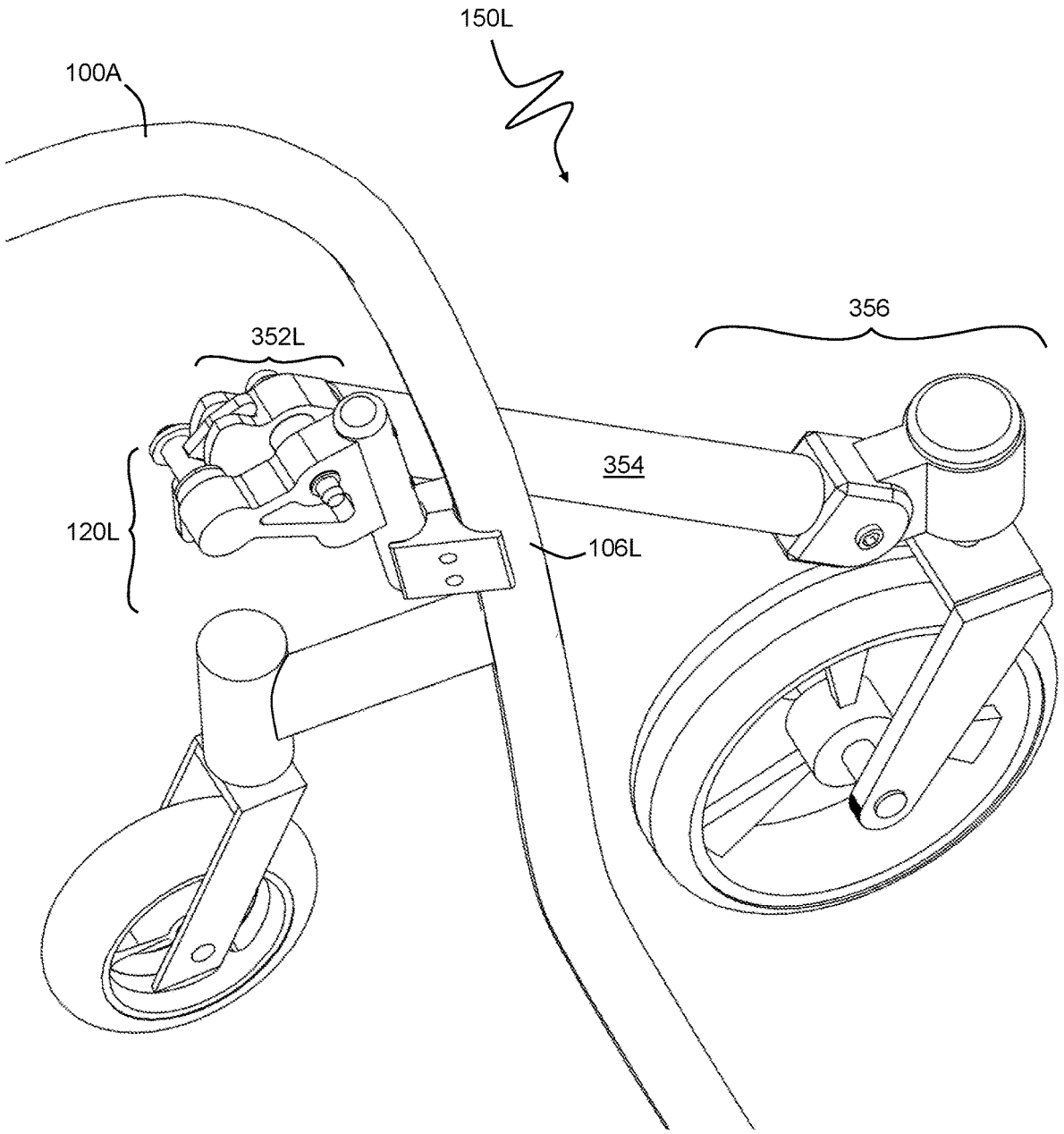
FIGS. 4B and 4C show close-up views illustrating the coupling of the left-sided ground-contacting adaptive implement with the left-sided front frame mount.
Figure 4C:
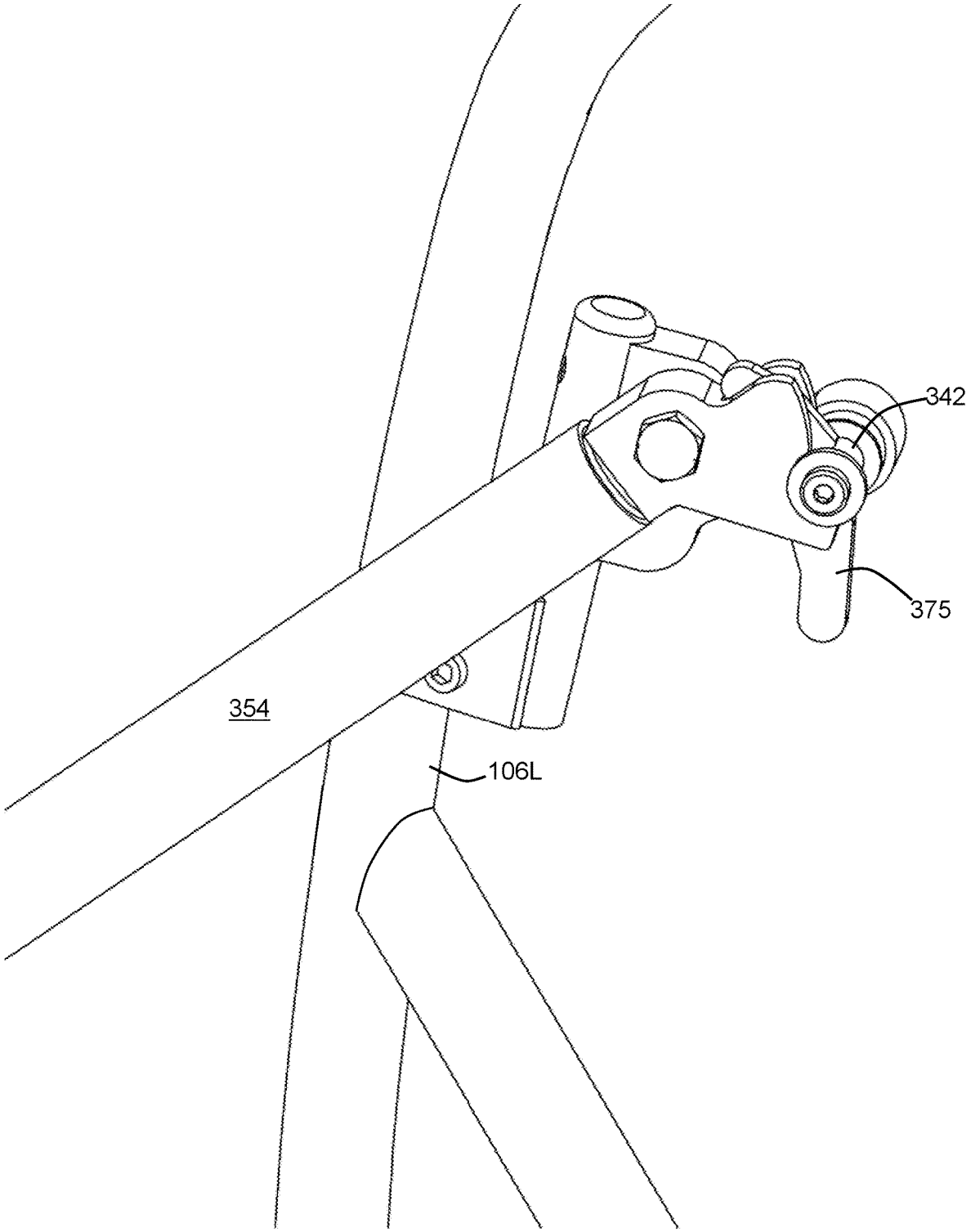

FIG. 4A shows the wheelchair having dual ground-contacting adaptive implements attached and deployed, with the front (primary) caster wheels of the wheelchair elevated from contact with the ground surface. FIGS. 4B and 4C show close-up views illustrating the coupling of the left-sided ground-contacting adaptive implement with the left-sided front frame mount.

For use of ground-contacting adaptive implements, such as caster wheels, omnidirectional wheels, or skis, downward rotation about a substantially horizontal rotation axis results in deployment of the ground-contacting adaptive implement in a predetermined position and orientation relative to the frame of the wheelchair and, in various embodiments, will also cause the front caster wheels of the wheelchair to become substantially elevated from contact with the ground surface, as indicated in FIG. 4A, wherein clearance gap 400 is created and maintained beneath the primary caster wheels 104L and 104R As visible in FIGS. 4B and 4C, upon coupling of rotary latch mechanism assembly 352L with frame mount 120L, caster wheel implement 150L becomes substantially unified with front down tube 106L, in effect enabling the caster wheel implement 150L to behave as a forward extension of the wheelchair 100A and to support a forward portion of a load carried by the wheelchair 100A. Thus, while the caster wheel implement 150L is maintained in a predetermined deployed position, rotary latch mechanism assembly 352L serves as a load-bearing intermediary between the wheelchair 100A and the caster wheel implement 150L. The same is true of the rotary latch mechanism assembly 352R integrated with the symmetrically opposing caster wheel implement 150R (visible in FIG. 4A).

Figure 5A:
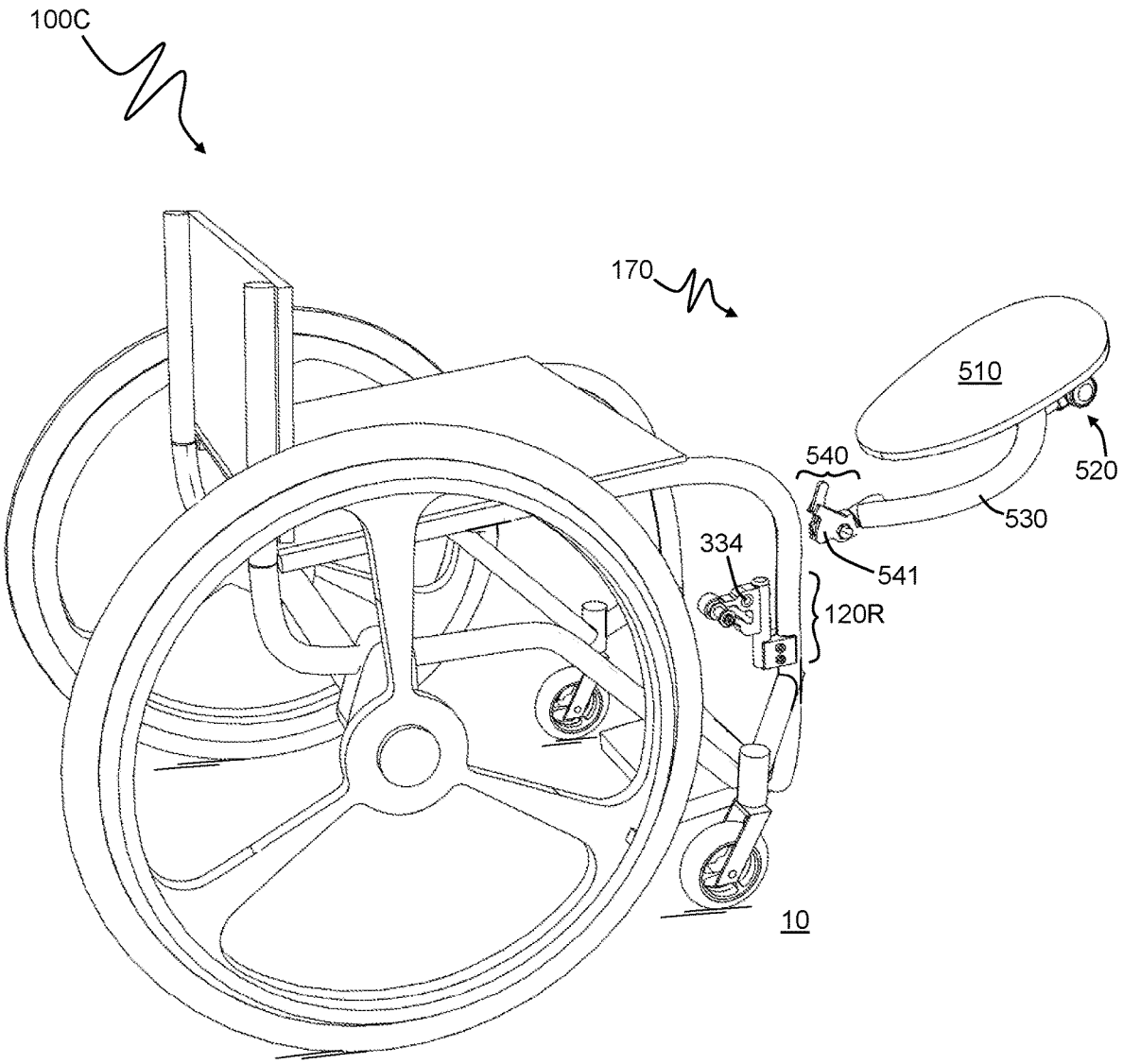
FIG. 5A depicts an elevated work surface implement detached from the wheelchair frame and adjusted, via an adjustable locking hinge, in a folded configuration for ease of storage. The elevated work surface implement has an upwardly-deploying rotary latch mechanism assembly.
Figure 5B:
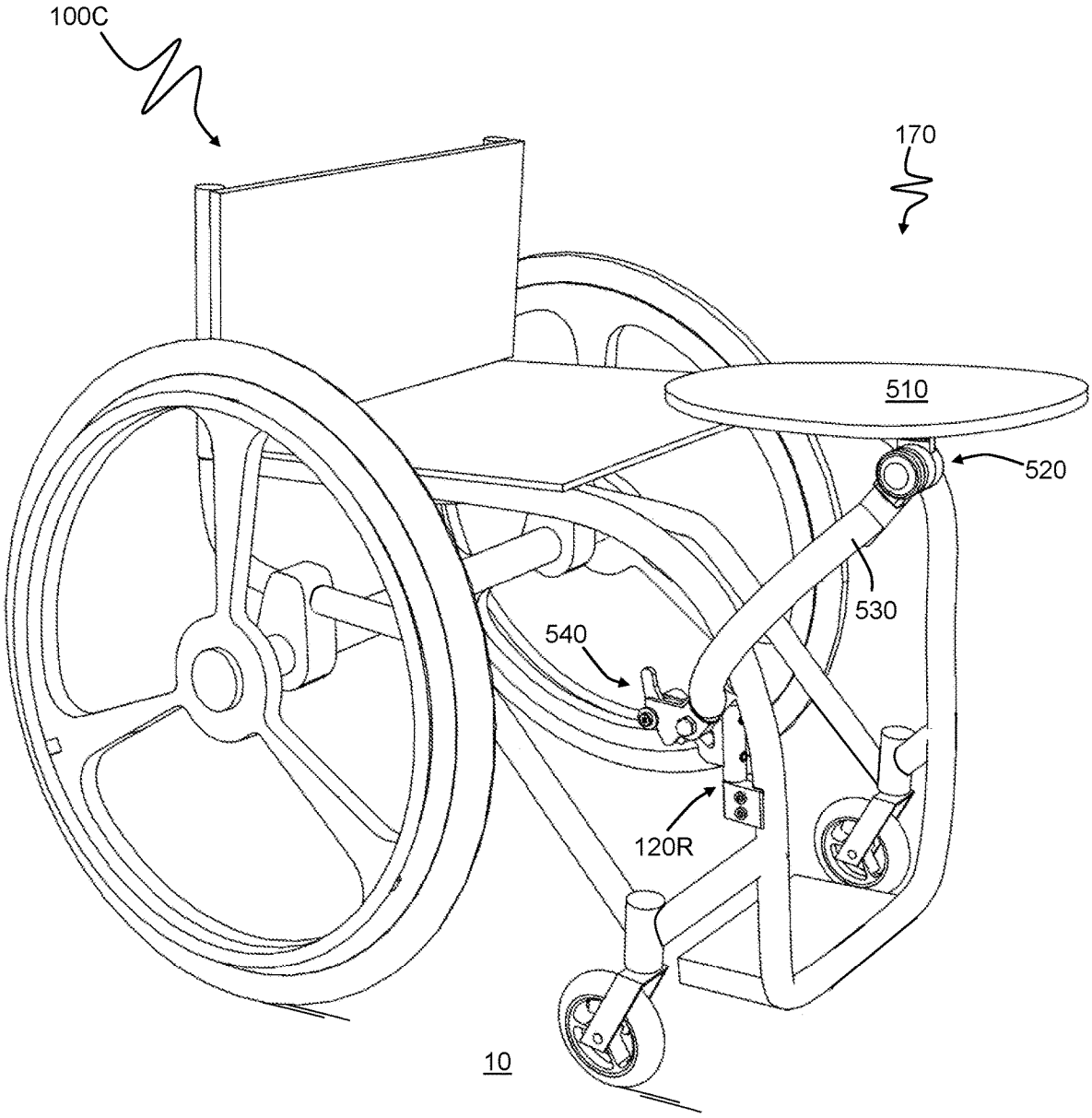
FIG. 5B depicts the elevated work surface implement attached to the right front down tube of the wheelchair frame and in a deployed position.

For use of some elevated type adaptive implements, such as a writing surface or an electronic device holder, it may be preferable to achieve deployment as a result of upward rotation thereof. In FIG. 5A, upwardly-deploying work surface implement 170 is shown detached from frame mount 120R (clamped onto wheelchair 100C) and folded into a collapsed configuration as a result of relative rotation of support plate 510 and curved arm 530 about a rotation axis passing through adjustable locking hinge 520. Adjustable locking hinge 520 is connected to a distal end portion of curved arm 530, whereas body 541 of upwardly-rotating latch assembly 540 is connected to a proximal end portion of curved arm 530. FIG. 5B shows upwardly-deploying work surface implement connected to wheelchair 100C via coupling of upwardly-rotating latch assembly 540 with frame mount 120R, said implement being maintained in a deployed orientation which enables an occupant of the wheelchair to utilize the work surface for activities such as writing, utilizing electronic devices, carrying a beverage, or for facilitating other activities of daily living.

Figure 5C:
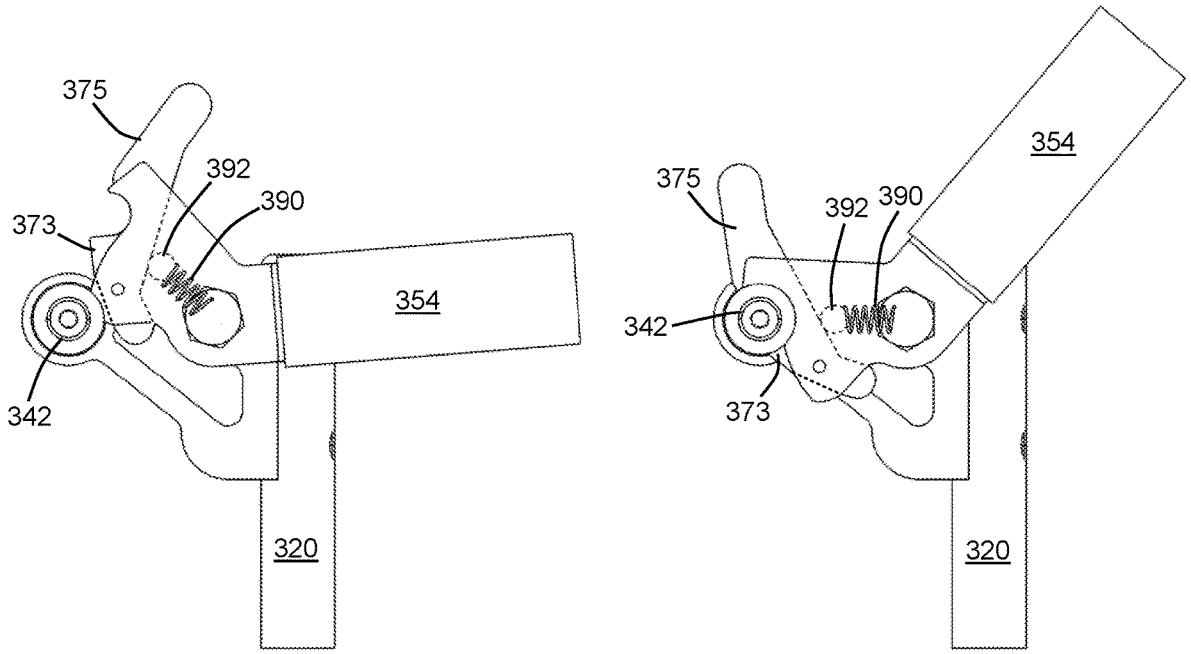
FIG. 5C illustrates the relative positioning of components of the upwardly-deploying rotary latch mechanism assembly during two distinct mechanism stages (pre-deployment and deployment).

Upon coupling of insertion pin 360 (not visible) with receptacle 334 (presented in FIG. 3C.) and upward rotation of work surface implement 170 as a result upward lifting thereof by the user, striker projection 373 contacts bearing post 342, with pivotable latch element 375 pivoting inwardly, until upward rotation of work surface implement 170 relative to mount assembly 120L (and wheelchair 100C) about insertion axis 250 (presented in FIGS. 2D and 3A) effectuates nesting of bearing post 342 against arcuate bearing surfaces 372 and 374 to stop further upward rotation of work surface implement 170. Next, pivotable latch element 375 rotates outwardly to effectuate nesting of bearing post 342 against arcuate bearing surface 378 of pivotable latch element 375, accompanied by an audible "click" as pivotable latch element 375 quickly rotates back into its outermost orientation as a result of urging force provided by spring 390. Striker projection 373 now inhibits downward rotation of work surface implement 170. By pushing inwardly against handle end 376 of pivotable latch element 375 to compress spring 390, the user is able to disengage the arcuate bearing surface 378 from bearing post 342, thereby permitting disengagement and downward rotation of the work surface implement 170 relative to the wheelchair 100C. FIG. 5C illustrates the relative positioning of the aforementioned elements of the upwardly-deploying rotary latch mechanism assembly, during the pre-deployment stage and during the deployment stage, in the case of an elevated type implement such as that illustrated in FIGS. 5A and 5B.

Figure 6A:
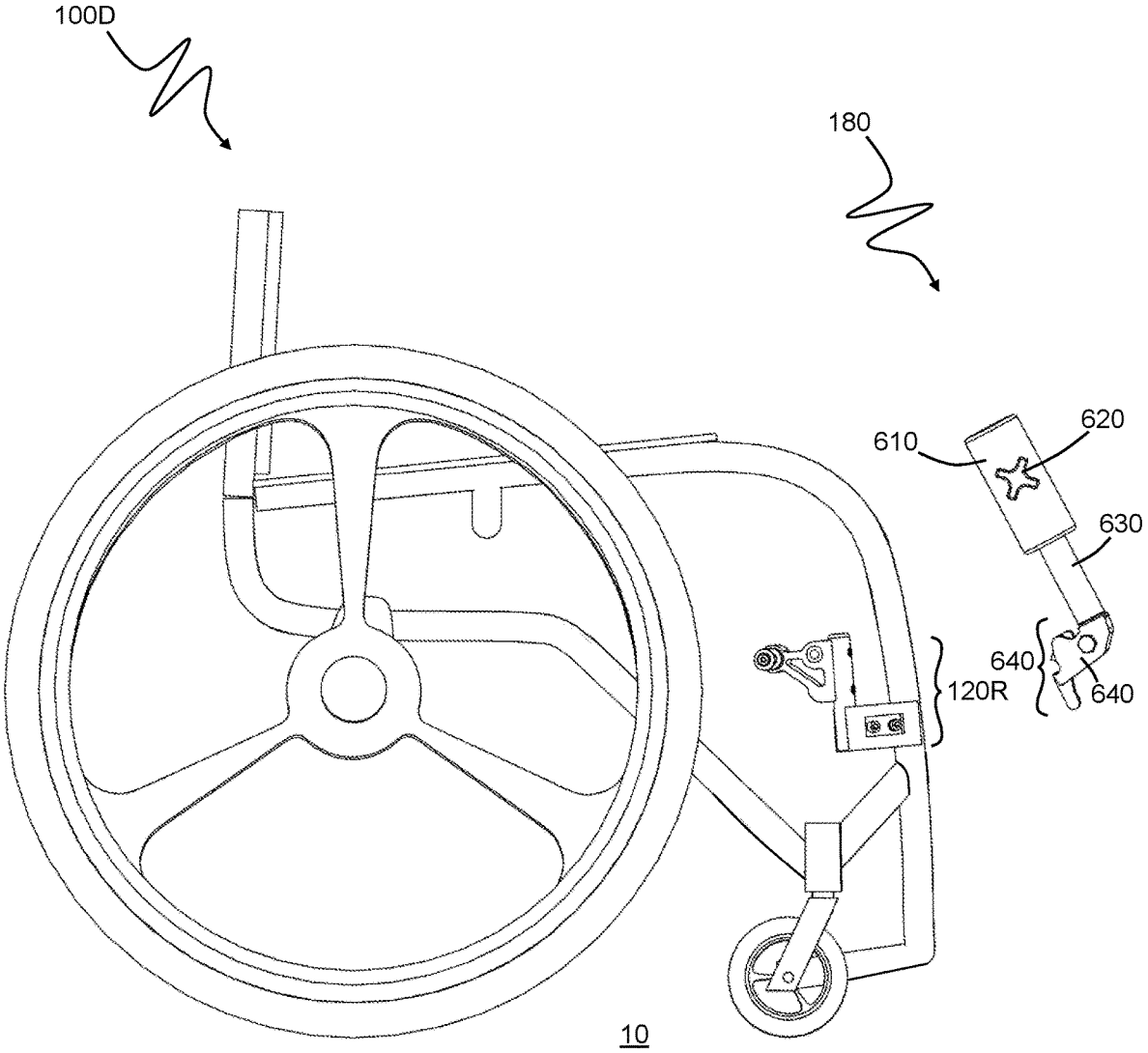
FIG. 6A depicts an elevated utility holder implement, having a downwardly-deploying rotary latch mechanism assembly, detached from the wheelchair frame.
Figure 6B:
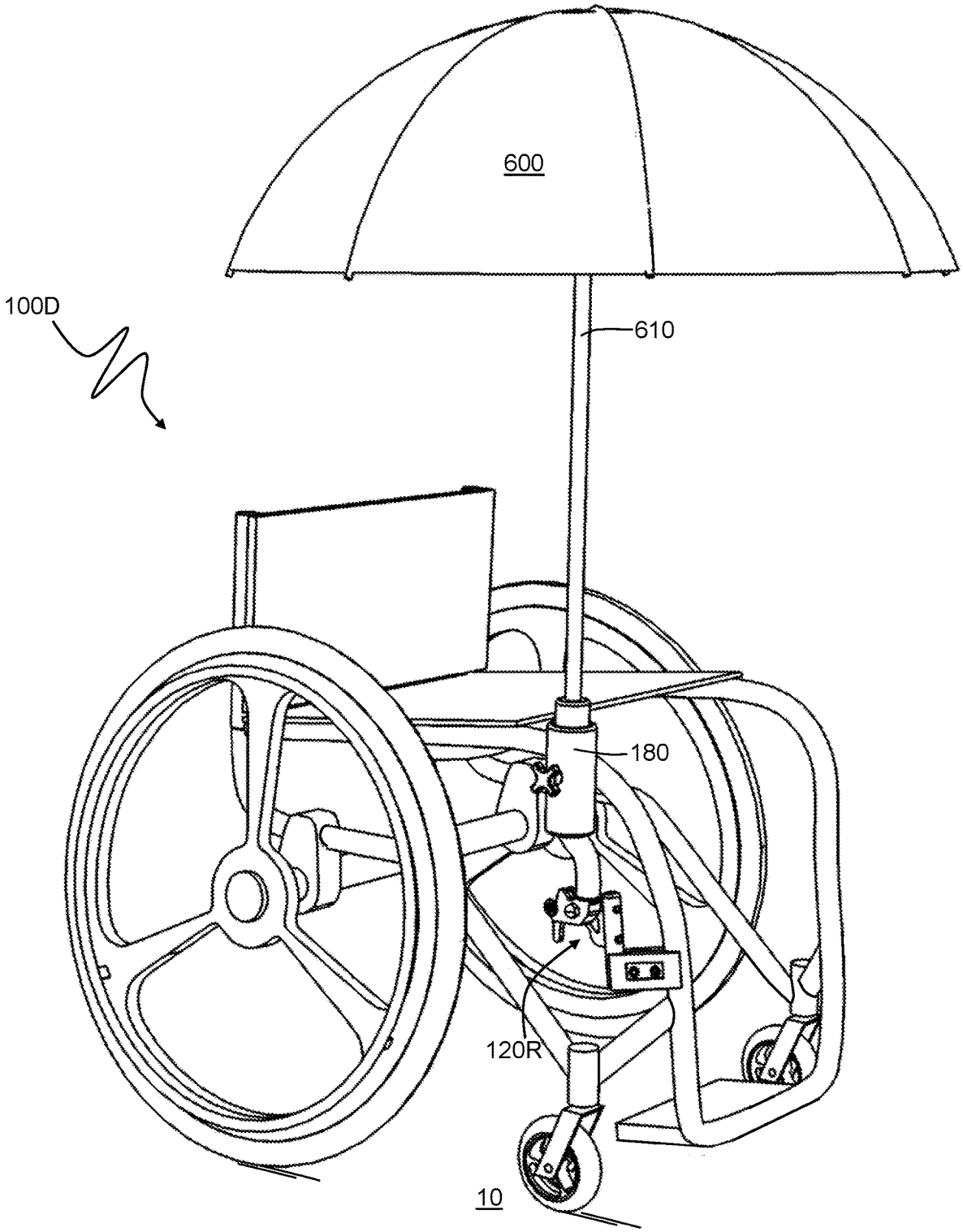
FIG. 6B depicts the elevated utility implement attached to the right front down tube of the wheelchair frame and in a deployed position. An umbrella is shown connected within a receptacle of the utility holder implement.

For use of some elevated type adaptive implements, such as an umbrella holder, a luggage or grocery carrier, or a medical device holder, it may be preferable to achieve deployment as a result of downward rotation thereof. In FIG. 6A, downwardly-deploying utility holder implement 180 is shown detached from frame mount 120R (clamped onto wheelchair 100D). Insert tube 610 is connected to a distal end portion of curved arm 630, whereas body 641 of downwardly-rotating latch assembly 640 is connected to a proximal end portion of curved arm 630. FIG. 6B shows downwardly-deploying utility holder implement 180 connected to wheelchair 100D via coupling of downwardly-rotating latch assembly 640 with frame mount 120R, said implement being maintained in a deployed orientation which enables an occupant of the wheelchair to utilize the utility holder implement 180 for purposes such as holding an umbrella (as illustrated in FIG. 6B).

Figure 6C:
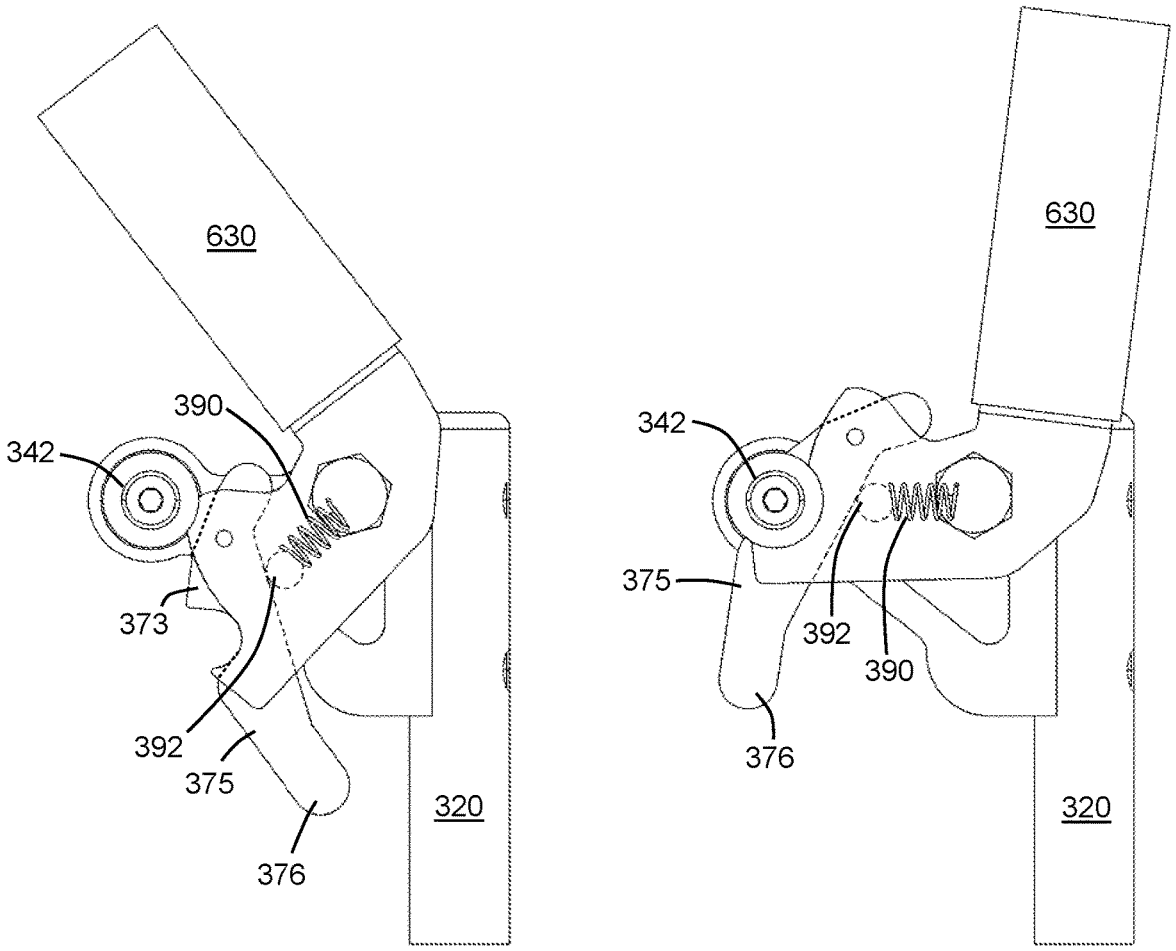
FIG. 6C illustrates the relative positioning of components of the downwardly-deploying rotary latch mechanism assembly during two distinct mechanism stages (pre-deployment and deployment).

Upon coupling of insertion pin 360 (not visible) with receptacle 334 (presented in FIG. 3C.) and downward rotation of utility holder implement 180 as a result of downward movement thereof enacted by the user, striker projection 373 contacts bearing post 342, with pivotable latch element 375 rotating inwardly, until downward rotation of utility holder implement 180 relative to mount assembly 120L (and wheelchair 100) about insertion axis 250 (presented in FIGS. 2D and 3A) effectuates nesting of bearing post 342 against arcuate bearing surfaces 372 and 374 to stop further downward rotation of utility holder implement 180. Next, pivotable latch element 375 rotates outwardly to effectuate nesting of bearing post 342 against arcuate bearing surface 378 of pivotable latch element 375, and may be accompanied by an audible "click" as pivotable latch element 375 quickly rotates back into its outermost orientation as a result of urging force provided by spring 390 against sphere 392. Striker projection 373 now inhibits upward rotation of utility holder implement 180. By pushing inwardly against handle end 376 of pivotable latch element 375 to compress spring 390, the user is able to disengage the arcuate bearing surface 378 from bearing post 342, thereby permitting disengagement and upward rotation of the utility holder implement 180 relative to the wheelchair 100A. FIG. 6C illustrates the relative positioning of the aforementioned elements of the downwardly-deploying rotary latch mechanism assembly, during the pre-deployment stage and during the deployment stage, in the case of an elevated type implement such as that illustrated in FIGS. 6A and 6B.

Figure 7A:
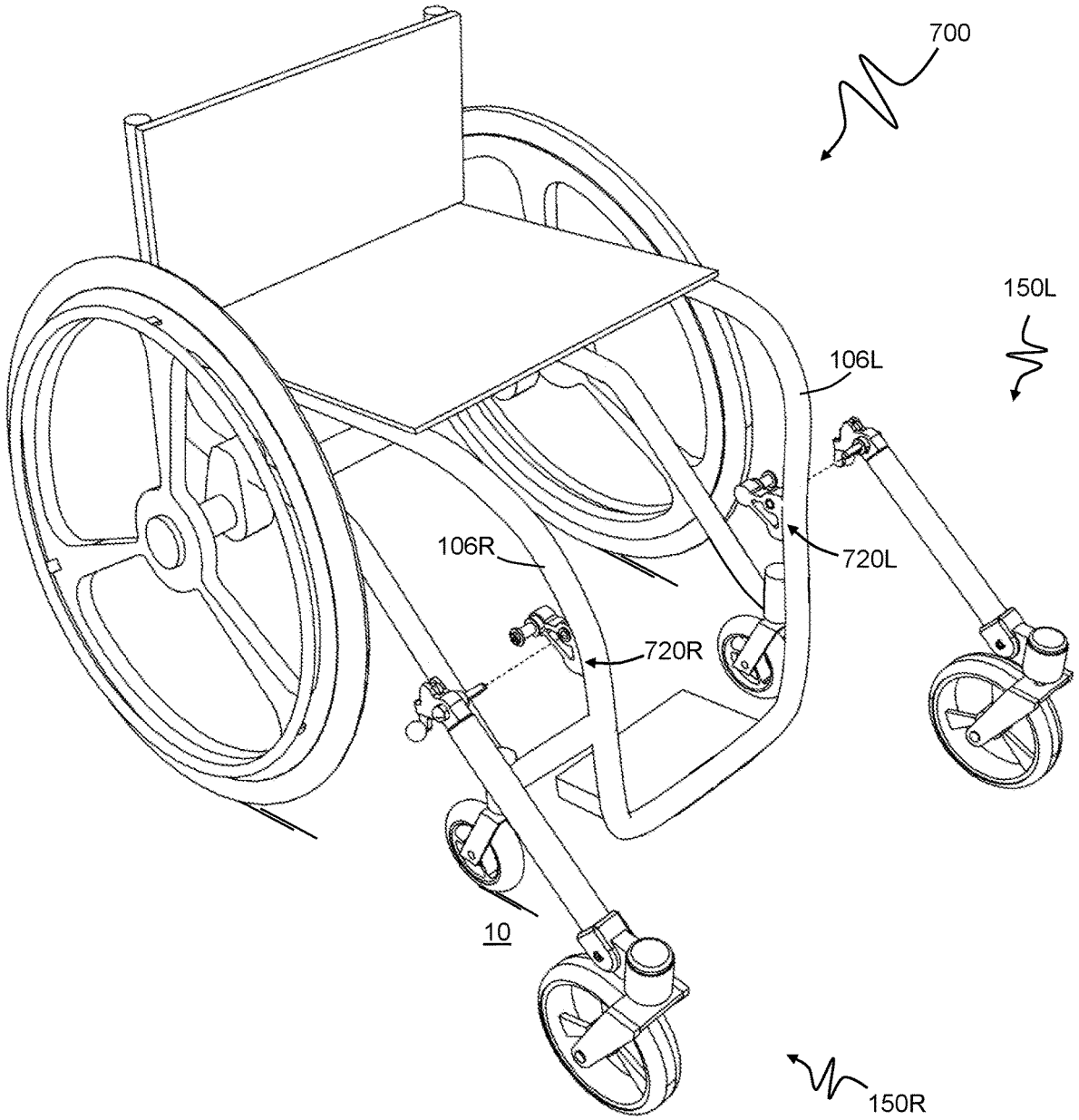
FIG. 7A shows an example wherein the frame mounts are welded to the left and right front down tubes of the wheelchair frame, with the wheelchair having the left-side caster wheel implement ready for connection to the left-side frame mount, and with the right-side caster wheel implement ready for connection to the right-side frame mount.
Figure 7B:
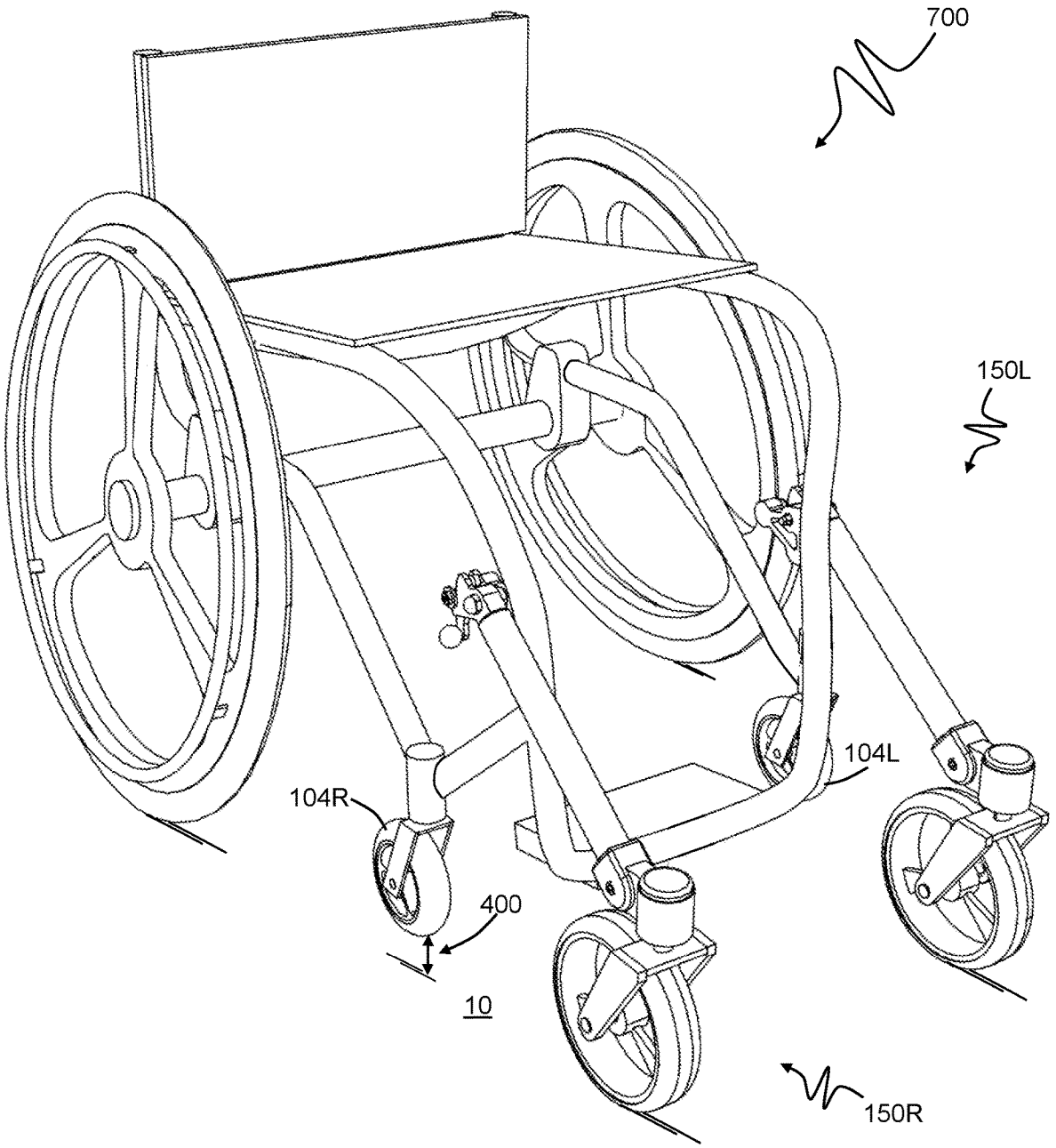
FIG. 7B shows the dual caster wheel implements connected to the wheelchair presented in the first alternative embodiment presented in FIG. 7A, the dual caster wheel implements each assuming a deployed orientation.

In FIG. 7A, frame mounts 720L and 720R are welded to the left and right front down tubes 106L and 106R of wheelchair 700, with the wheelchair having the left-side caster wheel implement 150L ready for connection to the left-side frame mount 720L, and with the right-side caster wheel implement 150R ready for connection to the right-side frame mount 720R. FIG. 7B shows the dual caster wheel implements connected to the wheelchair 700, with caster wheel implements 150L and 150R each assuming a deployed orientation and with primary caster wheels 104L and 104R substantially elevated from contact with ground surface 10 to form clearance gap 400 beneath primary caster wheels 104L and 104R.

Figure 8A:
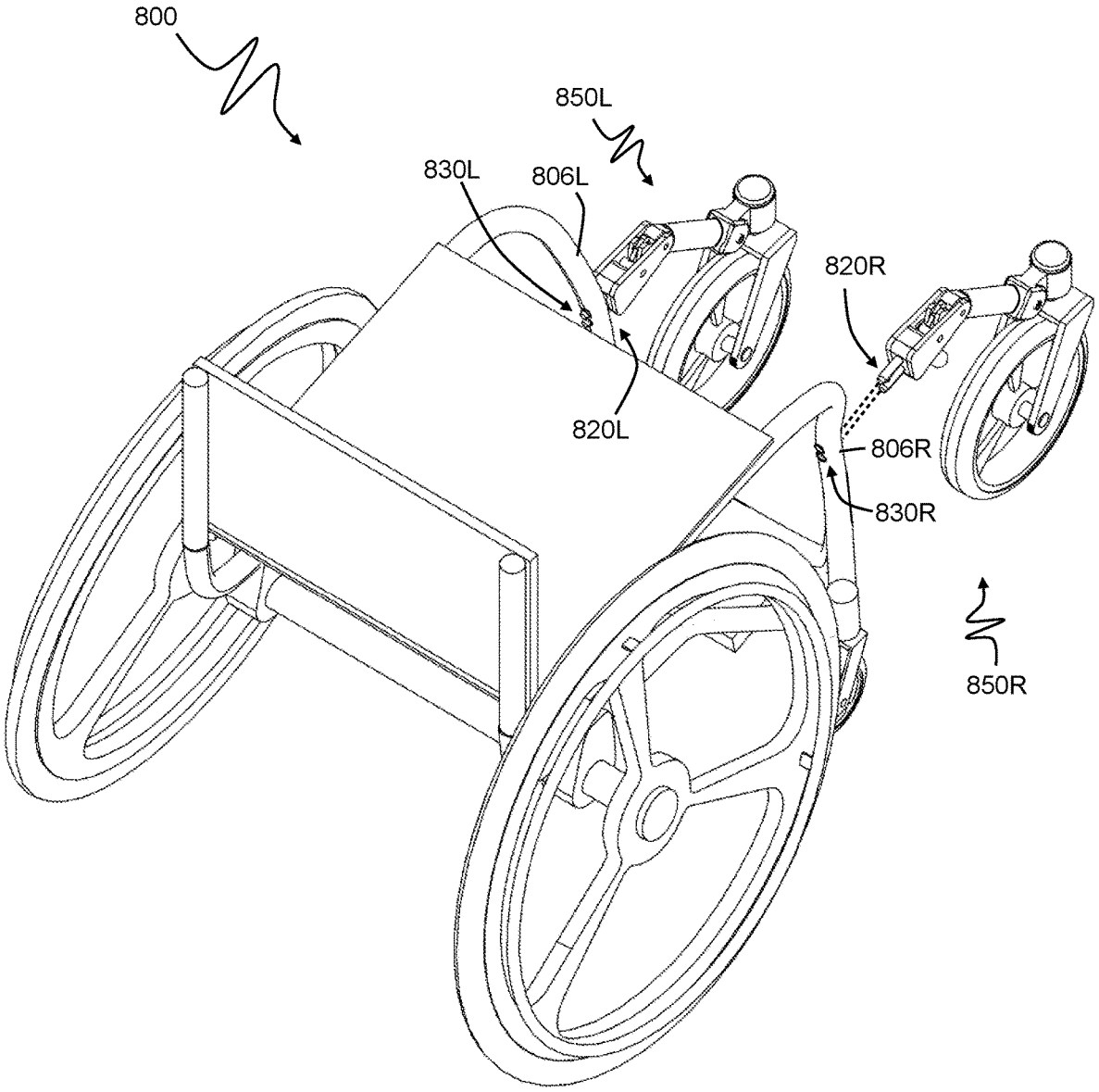
FIGS. 8A-D show an example wherein the receivers are integrated into the left and right front down tubes of the wheelchair frame, the wheelchair capable of being outfitted with ground-contacting implements and elevated type implements.

FIG. 8A shows an example wherein double-pin receivers 830L and 830R are integrated into the left and right front down tubes of the wheelchair frame. In this illustration, the wheelchair has the left-side caster wheel implement 850L connected to the left front down tube 806L of wheelchair 800, right-side caster wheel implement 850R being ready for connection to the right front down tube 806R of wheelchair 800. Double pin structures 820L and 820R are used for the releasable connection of each caster wheel implement to double-pin receivers 830L and 830R integrated with the wheelchair frame, so that each pair of pins projects longitudinally through a front down tube during connection of implements to create a rigid union between each implement and the wheelchair frame, and so that minimal structure is left remaining on the wheelchair during disconnection of the implements.

Figure 8B:
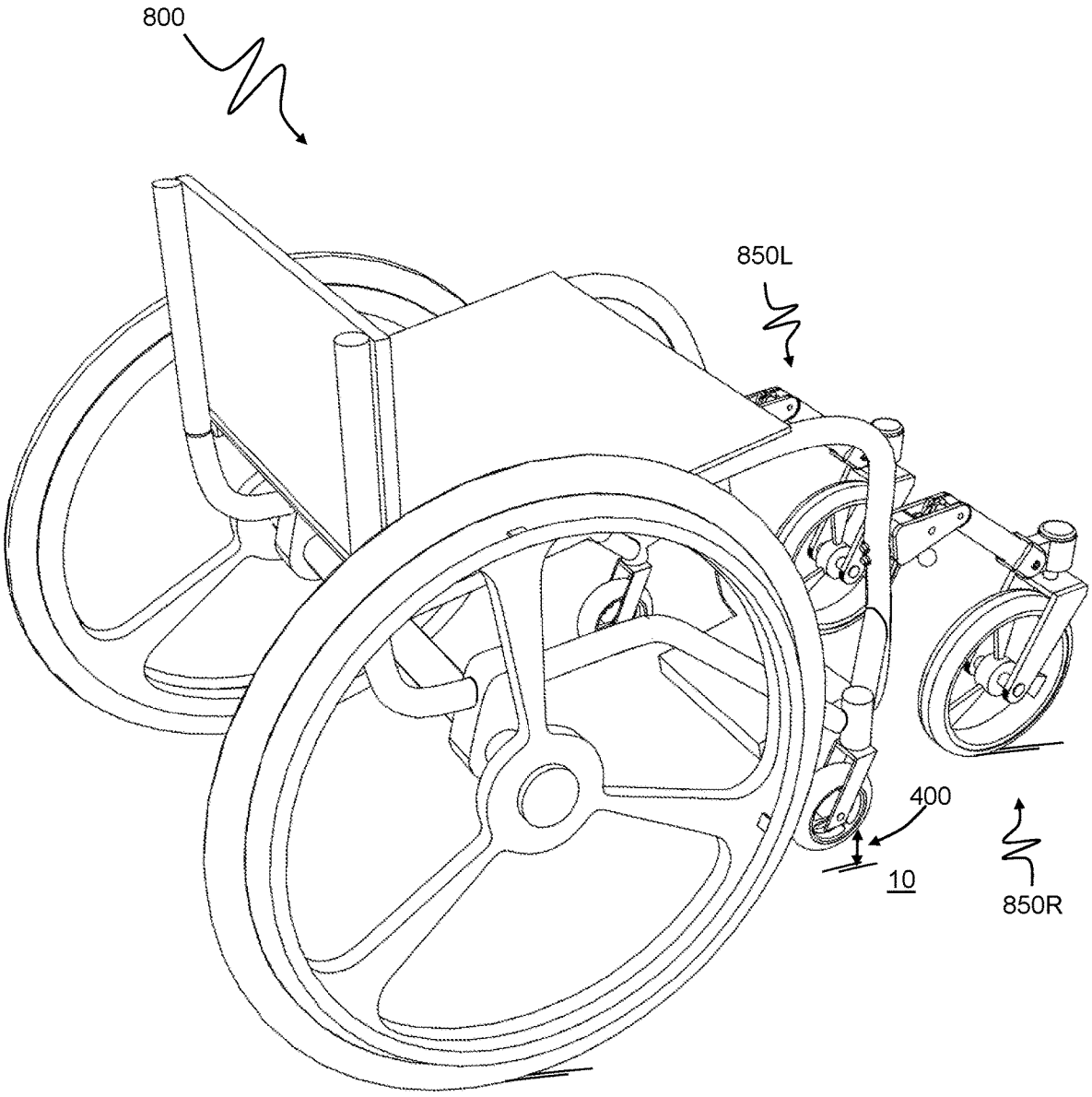

FIG. 8B shows the example presented in FIG. 8A, with the wheelchair 800 having caster wheel implements 850L and 850R attached to wheelchair 800.

Figure 8C:
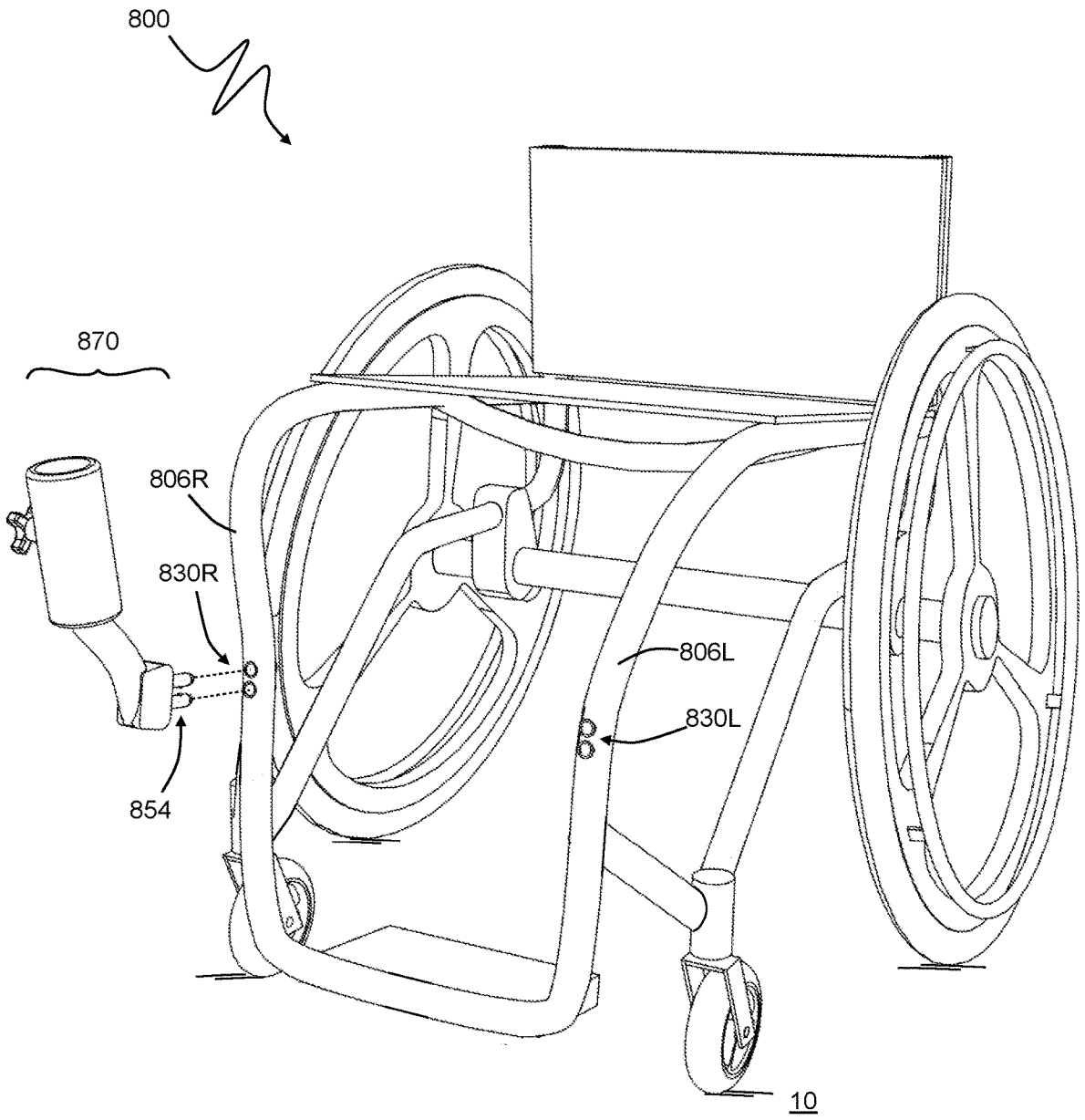
Figure 8D:
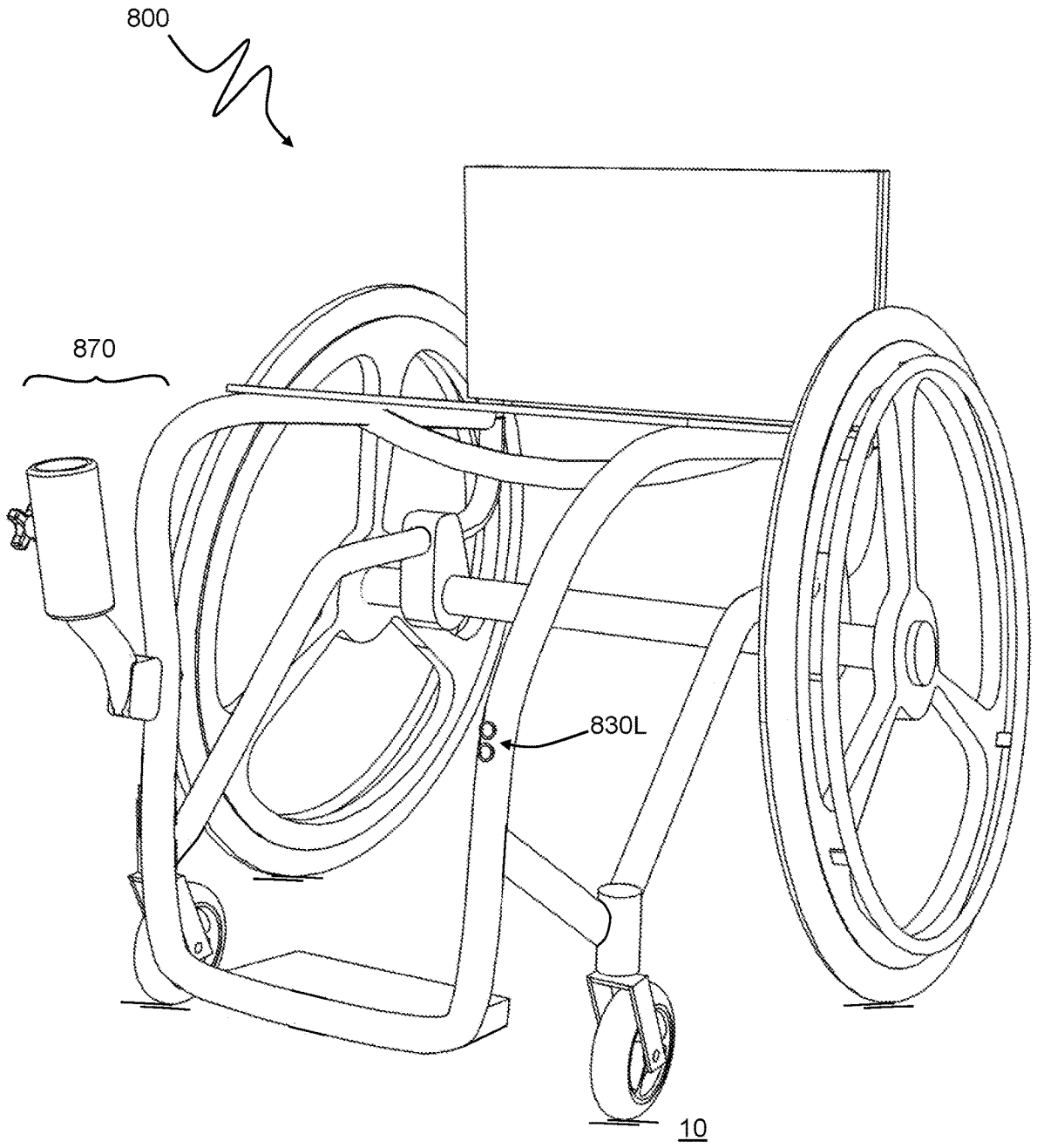

FIGS. 8C and 8D show the example presented in FIGS. 8A and 8B, utilized for connection of a multi-purpose elevated type attachment device 870 to right front down tube 806R of wheelchair 800, utilizing double-pin structure 854 to rigidly couple with double-pin receiver 830R along a longitudinal insertion axis projecting through front down tube 806L. Double-pin receiver 830L disposed on the left side of wheelchair 800 is shown unoccupied and having minimal structure protruding beyond the extents of front down tube 806L.

Figure 9A:
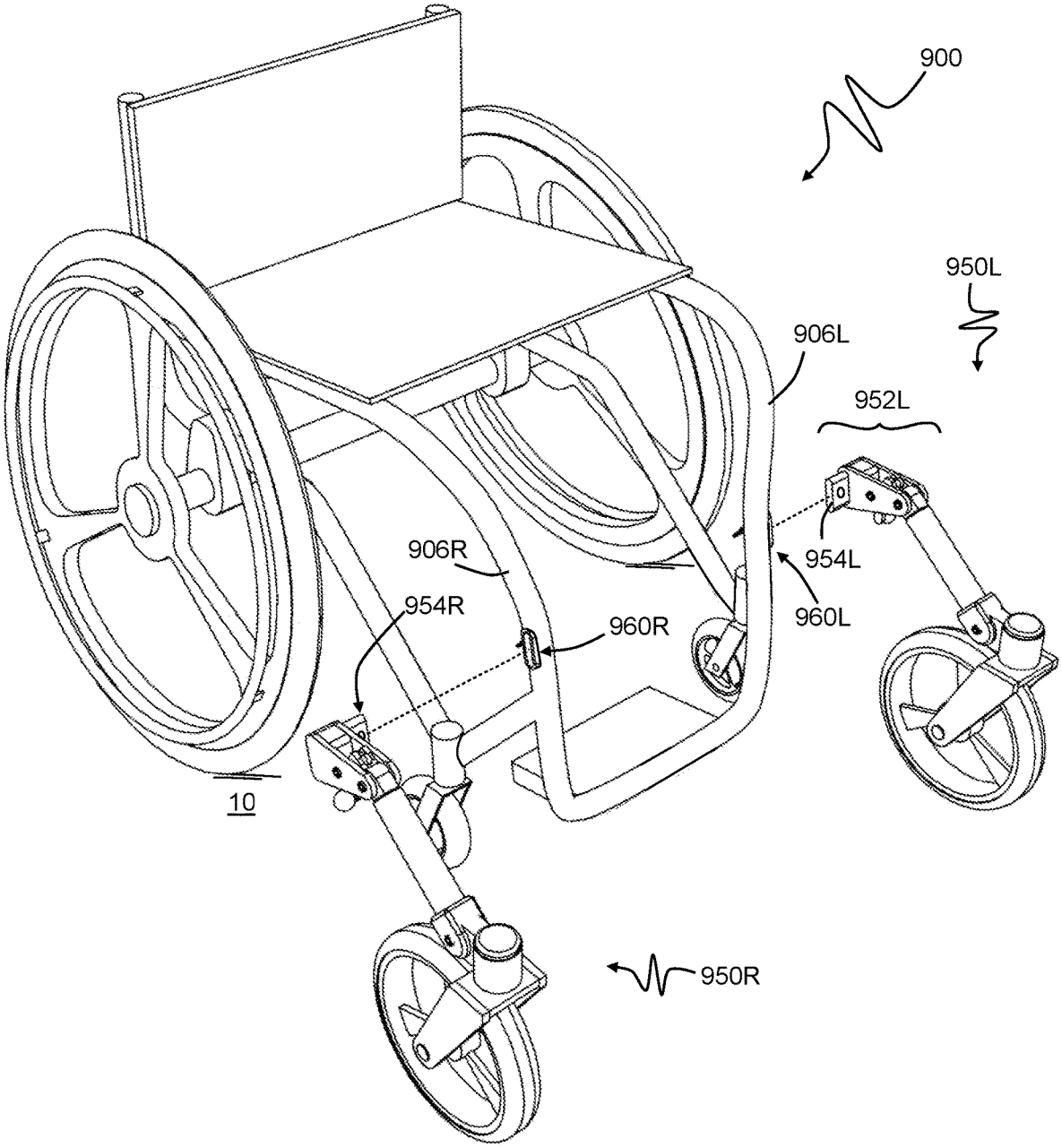
FIGS. 9A-F show an example wherein an oval insert and receiver coupling arrangement is used for releasable connection of ground-contacting and elevated type implements.

FIG. 9A shows an example having caster wheel implements 950L and 950R comprising oblong inserts 954L and 954R couple with oblong receivers 960L and 960R integrated within front down tubes 906L and 906R, respectively, for releasable connection of each caster wheel implement 950L and 950R, laterally, to the wheelchair. In this illustration, the left-side caster wheel implement and the right-side caster wheel implement are ready for connection to the left and right front down tubes.

Figure 9B:
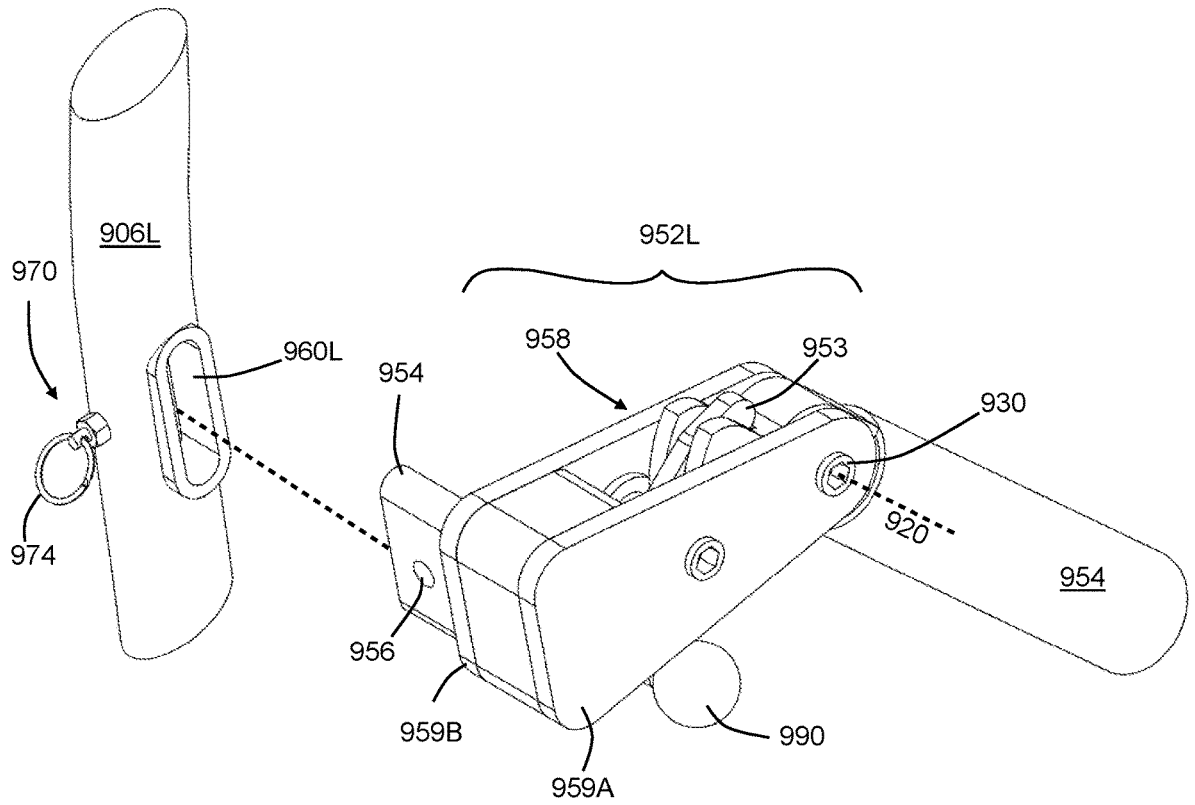
Figure 9C:
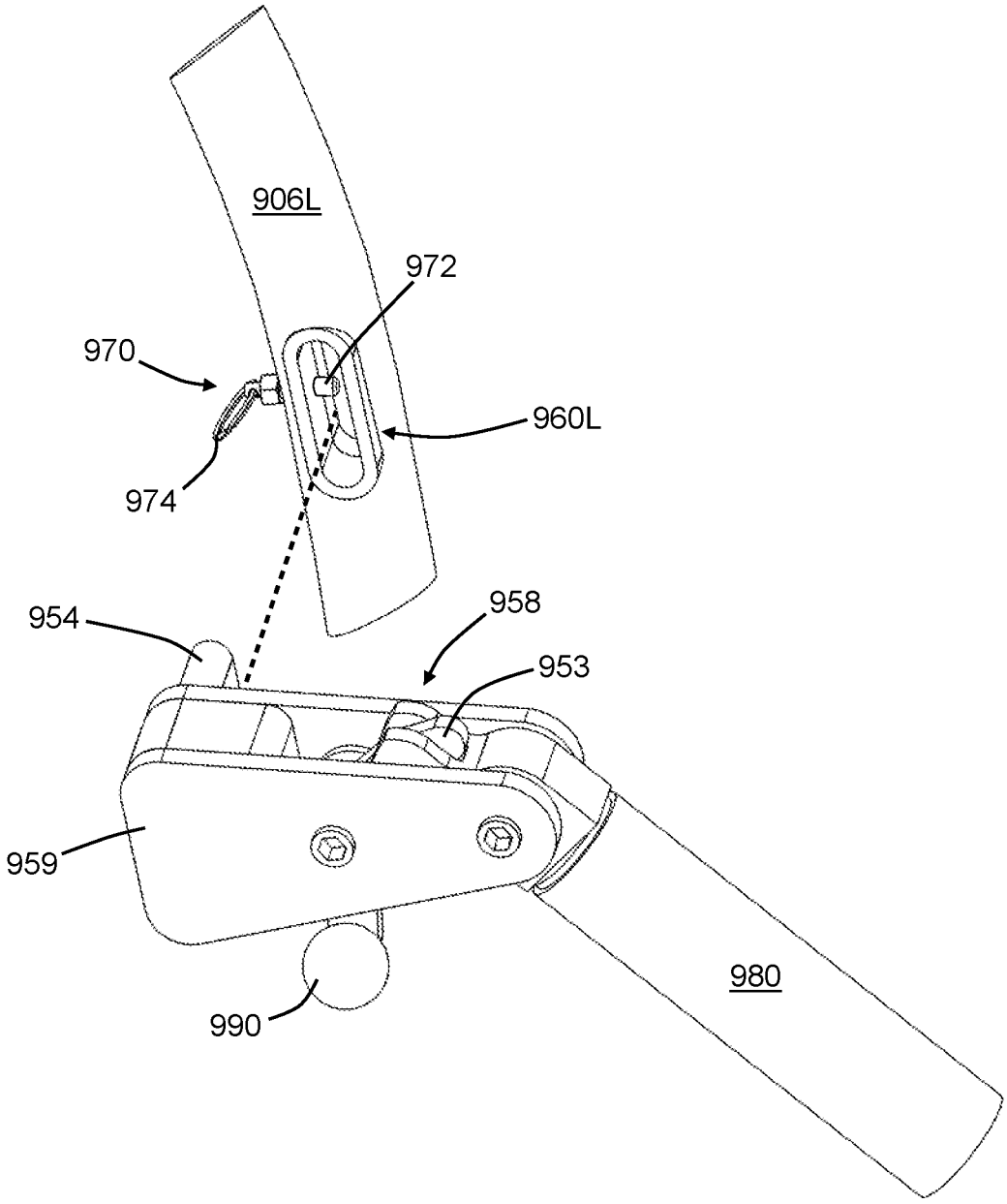

FIGS. 9B and 9C show close-up views of the insert and the receiver of the example presented in FIG. 9A. Latching mechanism 958 of rotary latch mechanism assembly 952L is operatively interposed between oblong insert 954 and arm 980 of caster wheel implement 950. Outer body members 959A and 959B give support to latching mechanism 958 and isolate rotation of arm 980 of caster wheel implement 950 about rotation axis 920 passing through rotary joint 930. Spherical knob 990 is visible beneath rotary latch mechanism assembly 952L, and is attached to pivotable latch element 953. Forward pressure placed against spherical knob 990 by a user imparts movement of pivotable latch element 953 in order to disengage rotary latch mechanism assembly 952L from load-bearing and to permit free rotation of arm 980 about rotation axis 920 relative to oblong insert 954. Retractable locking pin assembly 970 is disposed on a rearward portion of front down tube 906L, and comprises pull ring 974 which, upon being pulled rearwardly by a user, draws retractable locking pin 972 (visible in FIG. 9C) sufficiently away to permit free insertion and removal of oblong insert 954 relative to oblong aperture 960L. Oblong insert 954 comprises locking pin aperture 956 through which retractable locking pin 972 is capable of projecting upon insertion of oblong insert 954 into oblong receptacle 960L to provide positive locking action for preventing accidental release of oblong insert 954 relative to oblong receptacle 960L.

Figure 9D:
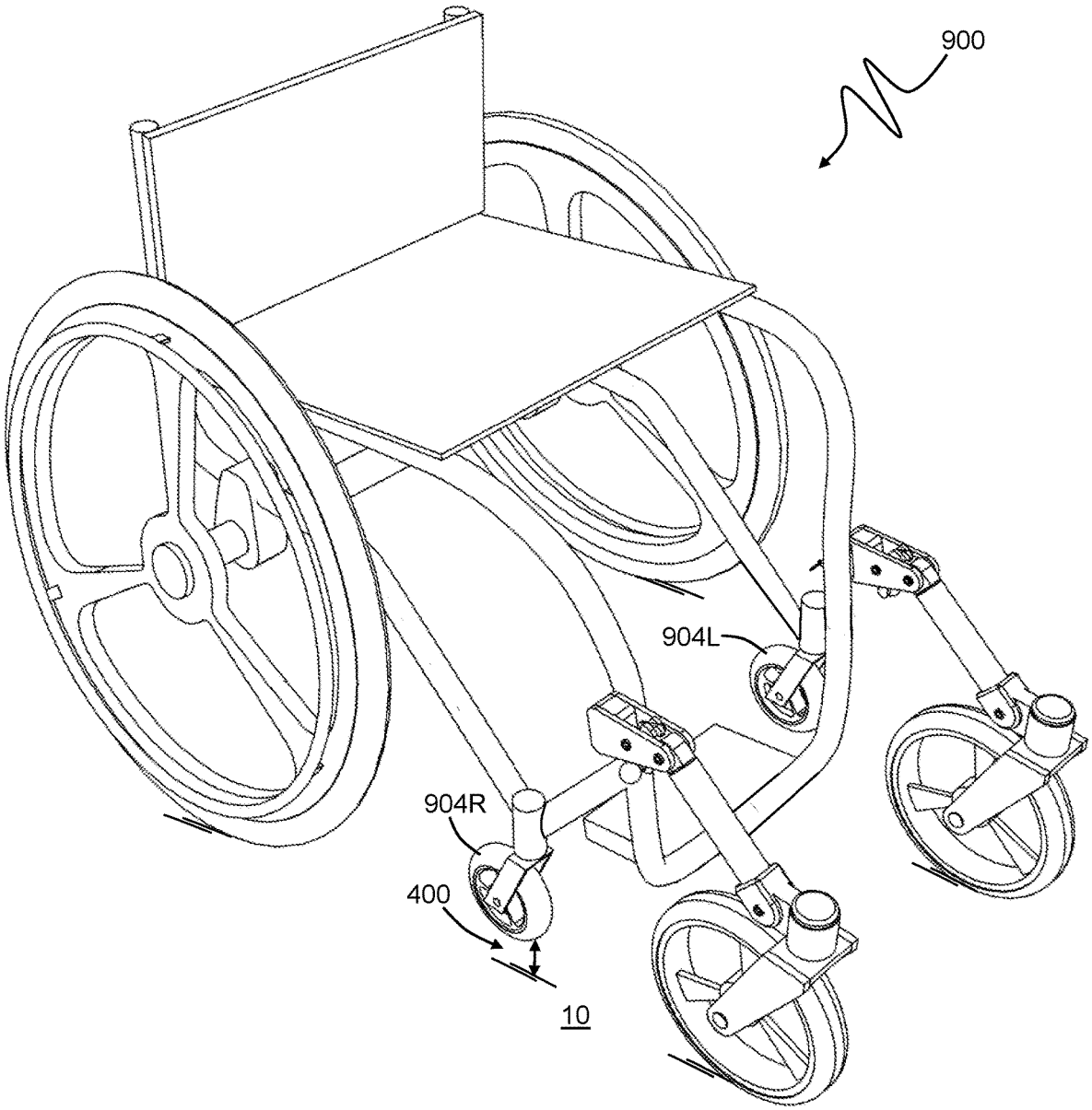

FIG. 9D shows the example presented in FIG. 9A-C, with wheelchair 900 having both the left-side and right-side caster wheel implements attached, with clearance gap 400 formed beneath primary caster wheels 904L and 904R, which are shown substantially elevated from contact with ground surface 10.

Figure 9E:
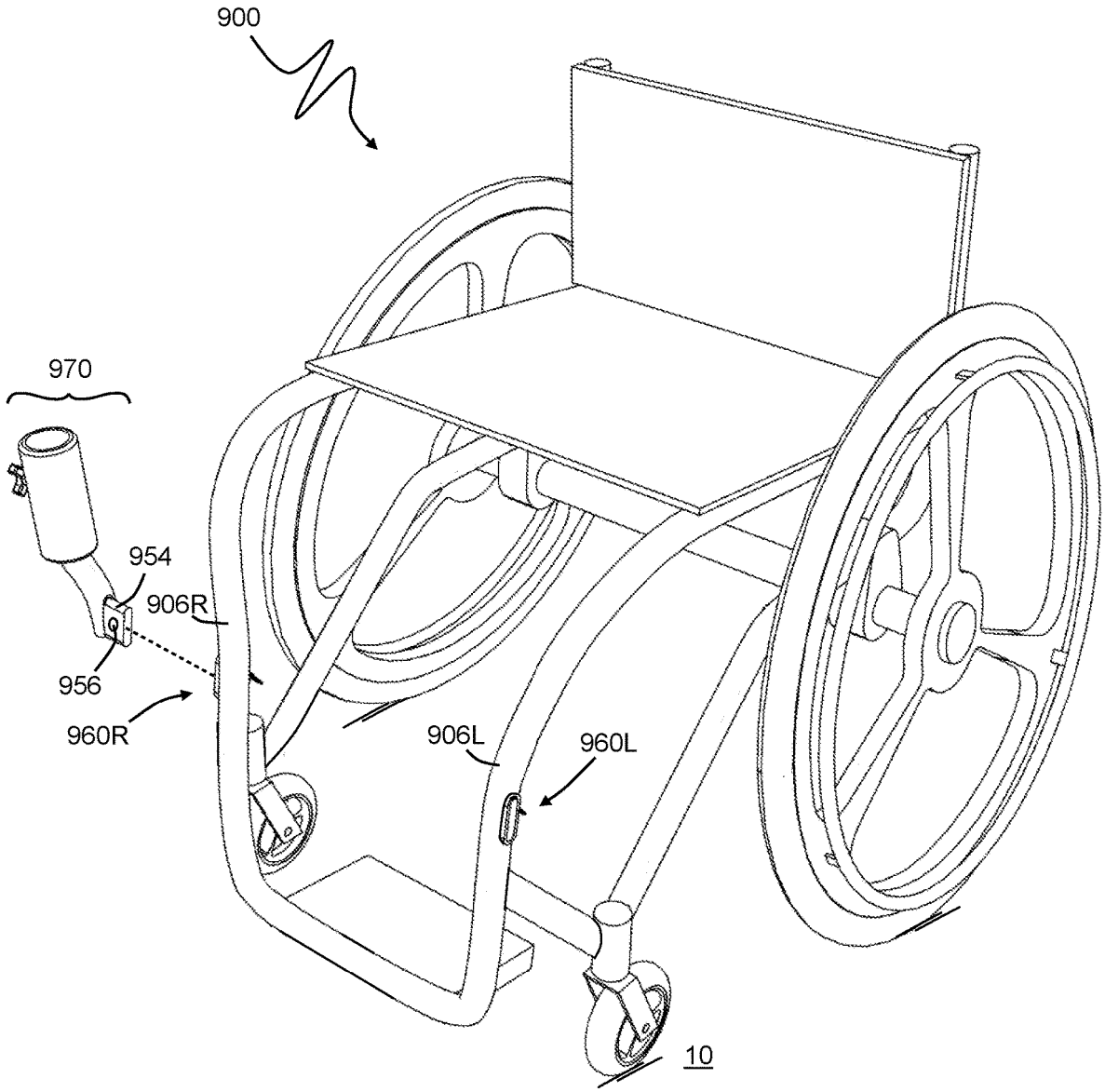
Figure 9F:
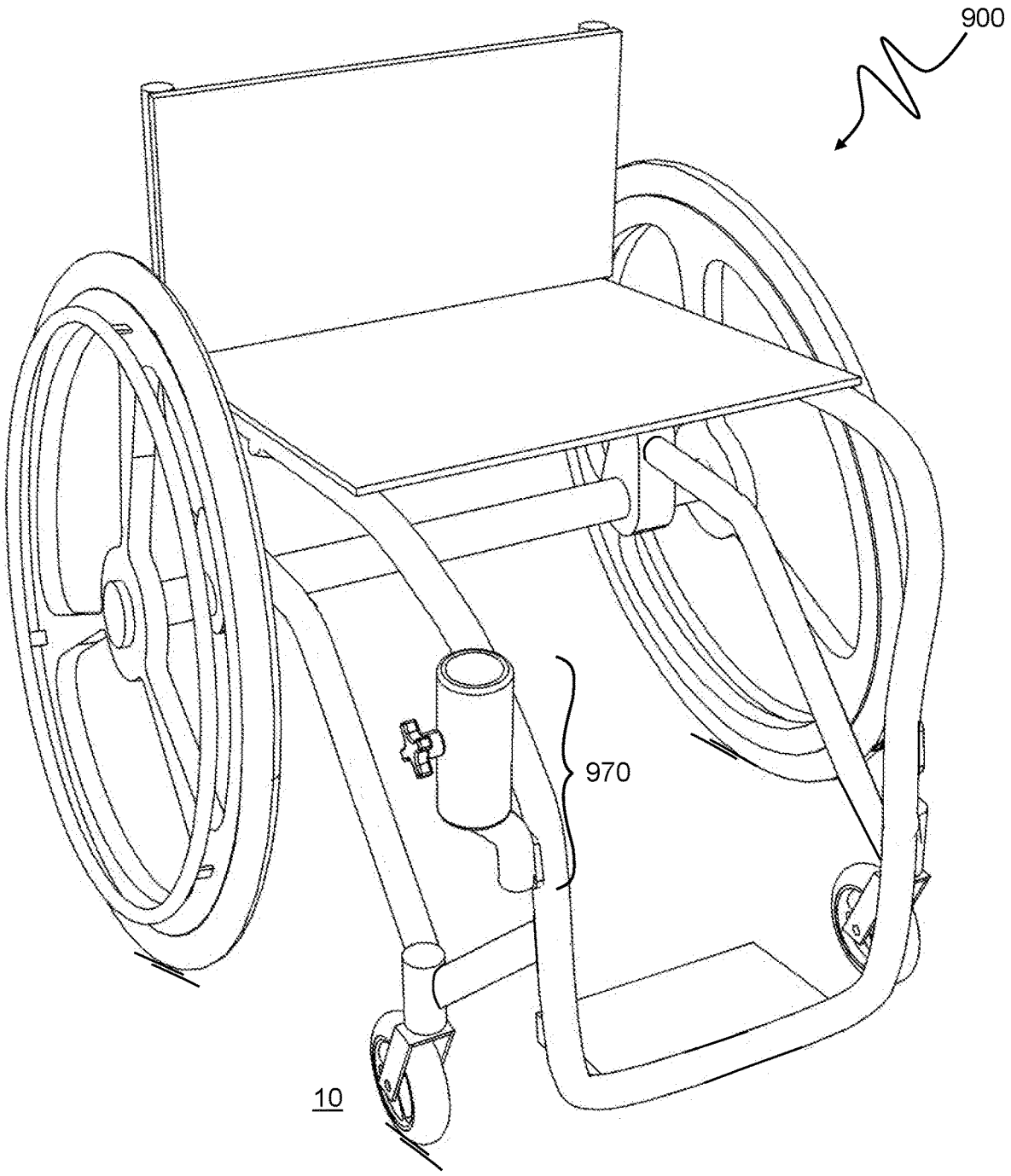

FIGS. 9E and 9F show the example presented in FIG. 9A-D utilized for connection of multi-purpose elevated type attachment device 970 having oblong insert 954 which couples with oblong receiver 960R along an insertion axis projecting laterally through front down tube 906R. Oblong receiver 960L disposed on front down tube 906L is shown unoccupied and having minimal structure protruding beyond the extents of front down tube 906L.

I claim:

1. A wheelchair system comprising a fixed coupling member adapted to remain integrated with a forward lateral portion of a wheelchair frame, the fixed coupling member capable of attachment of one of a first implement and a second implement, the wheelchair system capable of coupling the first implement to the fixed coupling member in a direction along a substantially horizontal line of insertion passing laterally through the fixed coupling member, the wheelchair system being further capable of maintaining the first implement in a predetermined lateral position along the substantially horizontal line of insertion relative to the fixed coupling member, the wheelchair system being further capable of coupling the second implement to the fixed coupling member in the direction along the substantially horizontal line of insertion, the wheelchair system being further capable of maintaining the second implement in the predetermined lateral position along the substantially horizontal line of insertion relative to the fixed coupling member, wherein the wheelchair system enables interchangeable connection of the first implement and the second implement to the fixed coupling member in a predetermined position relative to forward lateral portion of the wheelchair frame.

2. The wheelchair system of claim 1, the first implement being adapted for interposition between the fixed coupling member and a member adapted to support an auxiliary load.

3. The wheelchair system of claim 2, the member comprising a holder.

4. The wheelchair system of claim 2, the member comprising a tray.

5. The wheelchair system of claim 2, the member comprising a support surface.

6. The wheelchair system of claim 1, the second implement being capable of interposition between the fixed coupling member and a member adapted for contact with a ground surface beneath the wheelchair frame.

7. The wheelchair system of claim 6, the first implement being capable of interposition between the fixed coupling member and a member adapted to support an auxiliary load.

8. The wheelchair system of claim 6, the member comprising a wheel.

9. A system for enabling interchangeable connection of a plurality of implements to a wheelchair, the wheelchair comprising a seat, the wheelchair further comprising a first side having a first front down tube, the wheelchair further comprising a second side having a second front down tube, the wheelchair further comprising a pair of primary caster wheels, the pair of primary caster wheels being capable of supporting a forward portion of a load carried by the wheelchair, the system comprising a fixed coupling member adapted to remain interfaced with the first front down tube of the first side of the wheelchair, the system capable of coupling a first releasable coupling member to the fixed coupling member in a direction along a substantially horizontal line of insertion passing laterally through the fixed coupling member, the system being further capable of maintaining the first releasable coupling member in a predetermined lateral position along the substantially horizontal line of insertion relative to the fixed coupling member, the system being further capable of coupling a second releasable coupling member to the fixed coupling member in the direction along the substantially horizontal line of insertion, the system being further capable of maintaining the second releasable coupling member in the predetermined lateral position along the substantially horizontal line of insertion relative to the fixed coupling member.

10. The system of claim 9 being adapted to couple a ground-contacting-type implement to the fixed coupling member to interpose the fixed coupling member between the first front down tube of the first side of the wheelchair and the ground-contacting type implement to transmit a forward weight supported by the wheelchair through the fixed coupling member to the ground-contacting-type implement.

11. The system of claim 10, the ground-contacting-type implement comprising a wheel.

12. The system of claim 9 being adapted to couple an elevated-type implement to the fixed coupling member to interpose the fixed coupling member between the first front down tube of the first side of the wheelchair and the elevated-type implement to transmit weight carried by the elevated-type implement through the fixed coupling member to the wheelchair.

13. The system of claim 12, the elevated-type implement being adapted to support an auxiliary load.

14. A system for coupling an implement in a predetermined position relative to a forward lateral portion of a wheelchair frame, the system comprising a fixed coupling member adapted to remain interfaced with the forward lateral portion of the wheelchair frame, the system being capable of:

I. coupling a first releasable coupling member to the fixed coupling member in a direction along a substantially horizontal line of insertion passing substantially laterally through the fixed coupling member, the first releasable coupling member being adapted for contact with a ground surface;

II. maintaining the first releasable coupling member in a predetermined lateral position, relative to the fixed coupling member, along the substantially horizontal line of insertion passing substantially laterally through the fixed coupling member;

III. coupling a second releasable coupling member to the fixed coupling member in the direction along the substantially horizontal line of insertion passing substantially laterally through the fixed coupling member, the second releasable coupling member being adapted to support an auxiliary weight;

IV. maintaining the second releasable coupling member in the predetermined lateral position, relative to the fixed coupling member, along the substantially horizontal line of insertion passing substantially laterally through the fixed coupling member.

15. The system of claim 14 being adapted to transmit a forward portion of a weight, carried by the wheelchair frame, through the fixed coupling member to the first releasable coupling member, the first releasable coupling member capable of contacting the ground surface.

16. The system of claim 15 being adapted to transmit the auxiliary weight through the fixed coupling member to the forward lateral portion of the wheelchair frame.

17. The system of claim 14 being adapted to transmit the auxiliary weight through the fixed coupling member to the forward lateral portion of the wheelchair frame.

18. The system of claim 14 being adapted for loading about the substantially horizontal line of insertion in a first direction.

19. The system of claim 14 being adapted for loading about the substantially horizontal line of insertion in a second direction, the second direction opposing the first direction.

20. The system of claim 14 being adapted for interchange, relative to the fixed coupling member, of the first releasable coupling member and the second releasable coupling member.

* * * * *